US005093226A

United States Patent [19]

Ohshima

[11] Patent Number: 5,093,226

[45] Date of Patent: Mar. 3, 1992

[54] METHOD FOR FORMING IMAGE OF SILVER HALIDE COLOR PHOTOGRAPH

[75] Inventor: Naoto Ohshima, Kanagawa, Japan

[73] Assignee: Fuji Photo Film Co., Ltd., Kanagawa, Japan

[21] Appl. No.: 416,795

[22] Filed: Oct. 3, 1989

[30] Foreign Application Priority Data

Oct. 3, 1988 [JP] Japan ..... 63-249246

[51] Int. Cl.[5] ..... G03C 7/30; G03C 1/14

[52] U.S. Cl. ..... 430/377; 430/380; 430/382; 430/467; 430/490; 430/550; 430/584; 430/442

[58] Field of Search ..... 430/464, 467, 490, 567, 430/584, 377, 380, 382, 442

[56] References Cited

U.S. PATENT DOCUMENTS

| | | | |
|---|---|---|---|
| 4,565,774 | 1/1986 | Kajiwara et al. | 430/544 |
| 4,797,350 | 1/1989 | Ohbayashi et al. | 430/467 |
| 4,830,958 | 5/1989 | Okumura et al. | 430/584 |
| 4,837,140 | 6/1989 | Ikeda et al. | 430/550 |
| 4,851,326 | 7/1989 | Ishikawa et al. | 430/467 |
| 4,853,321 | 8/1989 | Momoki et al. | 430/467 |
| 4,892,803 | 1/1990 | Waki et al. | 430/467 |
| 4,939,080 | 7/1990 | Hioki et al. | 430/584 |
| 5,004,675 | 4/1991 | Yoneyama et al. | 430/467 |

FOREIGN PATENT DOCUMENTS

| | | | |
|---|---|---|---|
| WO87/4534 | 7/1987 | PCT Int'l Appl. | 430/467 |

OTHER PUBLICATIONS

James, "Effect of Halide Ion and Antifoggants in the Developer", pp. 417–419, 1977.

*Primary Examiner*—Richard L. Schilling
*Attorney, Agent, or Firm*—Sughrue, Mion, ZInn, Macpeak & Seas

[57] ABSTRACT

A method for forming an image of a silver halide color photograph, which comprises processing a silver halide color photographic material with a color developing solution containing at least one aromatic primary amine color developing agent, comprises: processing a silver halide color photographic material having at least one layer containing a compound represented by formula (S) and a silver halide emulsion comprising at least 80 mol % of silver chloride with a color developing solution containing chlorine ion in an amount of $3.5\times10^{-2}$ to $1.5\times10^{-1}$ mol/l and bromine ion in an amount of $3.0\times10^{-5}$ to $1.0\times10^{-3}$ mol/l:

wherein $Z_1$ represents a nitrogen atom, an oxygen atom, a sulfur atom or a selenium atom; $Z_2$ represents an oxygen atom, a sulfur atom or a selenium atom; $L_1$, $L_2$, $L_3$, $L_4$ and $L_5$ each represents a methine group which may be optionally substituted or may be combined together with another methine group to form a ring; $R_1$ and $R_2$ may be the same or different groups and each is an alkyl group; $R_1$ and $L_1$ or $R_2$ and $R_5$ may be combined together to form a five-membered or six-membered ring; $V_1$, $V_2$, $V_3$, $V_4$, $V_5$, $V_6$, $V_7$ and $V_8$ each represents a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group or an aryl group, and among $V_1$ to $V_8$, two groups attached to adjacent carbon atoms may be combined together to form a condensed ring; $(X_1)n_1$ represents a counter ion; and $n_1$ is a value required for the neutralization of 0 or more electric charges.

7 Claims, No Drawings

METHOD FOR FORMING IMAGE OF SILVER HALIDE COLOR PHOTOGRAPH

FILED OF THE INVENTION

This invention relates to a method for forming an image of a silver halide color photograph and more particularly to a method for forming an image which is scarcely fogged and is excellent in developability by using high silver chloride silver halide photographic materials.

BACKGROUND OF THE INVENTION

It has been desired to shorten processing time to bring about a shortening of delivery time and the saving of labor in the processing of color photographic materials in recent years. Generally, temperatures are elevated or the required amount of replenisher is increased to shorten time in each processing stage. Other methods for shortening time include a method wherein stirring is vigorously conducted and a method wherein various accelerators are added.

Particularly, there is known a method wherein there are processed color photographic materials containing a silver chloride emulsion in place of a silver bromide emulsion or a silver iodide emulsion which conventionally are widely used to expedite color development and/or to reduce the replenishment rate (i.e., the required amount of replenisher). For example, WO No. 87-04534 discloses a method wherein silver halide color photographic materials having a high silver chloride content are rapidly processed with color developing solutions which are substantially free from sulfite ion and benzyl alcohol.

However, it has been found that the above method has such disadvantages that when development is carried out by using automatic processors for paper, photographic characteristics (particularly minimum density) often fluctuate and the white area is greatly stained.

Accordingly the rapid processing of high silver chloride color photographic materials has a serious problem in that photographic characteristics fluctuate during processing. It is highly desired to solve the problem.

In the method for rapidly processing high silver chloride color photographic materials, it is known that organic anti-fogging agents are used to reduce the fluctuation of photographic characteristics (particularly fogging) in continuous processing. See, JP-A Nos. 58-95345 and 59-232342 (the term "JP-A" as used herein means an "unexamined published Japanese patent application"). However, it has been found that the effect of preventing fogging is insufficient, an increase in minimum density due to continuous processing can not be prevented from being caused and when large amounts of the anti-fogging agents are used, lowering in maximum density is caused.

JP-A No. 61-70552 discloses a method wherein silver halide color photographic materials having a high silver chloride content are used and developing solutions are added in such a low replenishment rate (i.e., a reduced amount of replenisher) that overflow into developing bath is not caused during development.

JP-A No. 63-106655 discloses a method wherein silver halide color photographic materials containing silver halide emulsion layers having a high silver chloride content are processed with color developing solutions containing hydroxyamine compounds and chlorides at an exceeding concentration of a desired concentration to provide a stabilized processing.

In these methods, however, fluctuation in photographic characteristics caused by processing using automatic processors are found during continuous processing, and the above-mentioned problems are not solved.

SUMMARY OF THE INVENTION

An object of the present invention is to provide a method for forming an image, which allows photographic characteristics high in maximum density and low in minimum density to be kept and scarcely causes the fluctuation of photographic characteristics (particularly minimum density) by continuous processing in the rapid processing of high silver chloride color photographic materials.

The above and other objects of the present invention have been achieved by providing a method for forming an image, which comprises processing a silver halide color photographic material with a color developing solution containing at least one aromatic primary amine color developing agent, comprising: processing a silver halide color photographic material having at least one layer containing a silver halide emulsion comprising at least 80 mol% of silver chloride and a compound represented by formula (S) with a color developing solution containing chlorine ion in an amount of $3.5\times10^{-2}$ to $1.5\times10^{-1}$ mol/l and bromine ion in an amount of $3.0\times10^{-3}$ to $1.0\times10^{-3}$ mol/l.

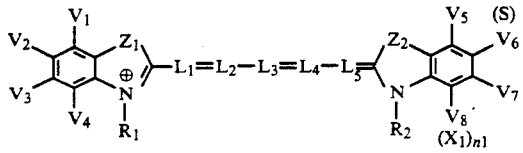

In formula (S), $Z_1$ represents a nitrogen atom, an oxygen atom, a sulfur atom or a selenium atom; and $Z_2$ represents an oxygen atom, a sulfur atom or a selenium atom.

$L_1$, $L_2$, $L_3$, $L_4$ and $L_5$ each represents a methine group which may be optionally substituted or may be combined together with another methine group to form a ring.

$R_1$ and $R_2$ may be the same or different groups and each represents an alkyl group; and $R_1$ and $L_1$ or $R_2$ and $L_5$ may be combined together to form a five-membered or six-membered carbon ring.

$V_1$, $V_2$, $V_3$, $V_4$, $V_5$, $V_6$, $V_7$ and $V_8$ each represents a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group or an aryl group; and among $V_1$ to $V_8$, two groups attached to adjacent carbon atoms may be combined together to form a condensed ring.

$(X_1)_{n1}$ represents a counter ion (electric charge-balancing counter ion); and $n_1$ is a value required for the neutralization of 0 or more electric charges.

It is known that chlorine ion is an anti-fogging agent. However, the effect obtained thereby is small and an increase in fogging caused by continuous processing can not be perfectly prevented even when a large amount of chlorine ion is used. Chlorine ion has such adverse effects that development is retarded and maximum density and sensitivity are lowered.

Further, it is well-known that bromine ion is an antifogging agent, and fogging caused by continuous processing can be prevented when a certain amount of bromine ion is added. However, when using bromine ion development is retarded and maximum density and sensitivity are lowered and hence it is of no practical use.

The present inventors have made studies and found that when a high silver chloride photographic material having a silver chloride content of not lower than 80 mol% and containing a compound represented by formula (S) is processed with a color developing solution containing chlorine ion in an amount of $3.5\times10^{-2}$ to $1.5\times10^{-1}$ mol/l and bromine ion in an amount of $3.0\times10^{-5}$ to $1.0\times10^{-3}$ mol/l, the fluctuation of photographic characteristics (particularly minimum density) caused by continuous processing carried out by using automatic processors can be prevented.

This effect can not be obtained by either chlorine ion or bromine ion alone. Accordingly, it is an unexpected finding that such an effect can be obtained by a combination within the range of the concentrations described above according to the present invention.

JP-A No. 63-106655 discloses a method wherein photographic materials having a silver chloride content of not lower than 70 mol% and containing a compound represented by formula (S) are processed with developing solutions containing not less than $2\times10^{-2}$ mol of chlorides. However, the concentrations of bromides in the developing solutions are outside the scope of the present invention, and the unexpected effects obtained by a combination of appropriate amounts of bromine ion and chlorine ion according to the present invention are not suggested. Further, the problems to be solved by the present invention are not discussed. Thus, it is considered that the present invention can not be conceived from the disclosure of the above patent specification.

In the present invention, the fluctuation of photographic characteristics caused by continuous processing can be prevented by a combination of proper amounts of chlorine ion and bromine ion. It is not considered that this effect is obtained merely by a balance between high developing activity due to the use of high silver chloride emulsion and a lowering in activity due to the presence of the proper amounts of bromine ion and chlorine ion. Namely, it is not considered that the fluctuation of photographic characteristics can be inhibited only by high-activity, high inhibiting type development. The effect obtained by a combination of bromine ion and chlorine ion within the range of concentrations defined above will be made clear by the following detailed description.

DETAILED DESCRIPTION OF THE INVENTION

In the present invention, it is necessary that the color developing solution contains chlorine ion at a concentration of $3.5\times10^{-2}$ to $1.5\times10^{-1}$ mol/l, preferably $4\times10^{-2}$ to $1.0\times10^{-1}$ mol/l. When the concentration of chlorine ion is higher than $1.5\times10^{-1}$ mol/l, there is a disadvantage that development is retarded and the objects of carrying out rapid processing and obtaining high maximum density can not be achieved, while when the concentration is lower than $3.5\times10^{-2}$ mol/l, photographic characteristics (particularly minimum density) greatly fluctuates during continuous processing, the amount of residual silver is large and the object of the present invention can not be achieved.

In the present invention, it is necessary that the color developing solution contains bromine ion at a concentration of $3.0\times10^{-5}$ to $1.0\times10^{-3}$ mol/l, preferably $5.0\times10^{-5}$ to $5\times10^{-4}$ mol/l. When the concentration of bromine ion is higher than $1.0\times10^{-3}$ mol/l, development is retarded and maximum density and sensitivity are lowered, while when the concentration is lower than $3.0\times10^{-5}$ mol/l, the fluctuation of photographic characteristics (particularly minimum density) caused by continuous processing can not be prevented and the object of the present invention can not be achieved.

Chlorine ion and bromine ion may be directly added to the developing solution or may be dissolved out from the photographic material in the developing solution.

When chlorine ion and bromine ion are directly added to the color developing solution, examples of chlorine ion supply sources include sodium chloride, potassium chloride, ammonium chloride, nickel chloride, magnesium chloride, manganese chloride, calcium chloride and cadmium chloride. Among them, sodium chloride and potassium chloride are preferred. Chlorine ion may be added in the form of a counter salt of a fluorescent brightener to be added to the developing solution. Examples of bromine ion supply sources include sodium bromide, potassium bromide, ammonium bromide, lithium bromide, calcium bromide, magnesium bromide, manganese bromide, nickel bromide, cadmium bromide, cerium bromide and thallium bromide. Among them, potassium bromide and sodium bromide are preferred.

When bromine ion and chlorine ion are dissolved out from the photographic material in the developing solution, both chlorine ion and bromine ion may be supplied from emulsions or other sources.

It is preferred from the viewpoints of processing stability during continuous processing and the prevention of line-form pressure marks that the color developing solution contains substantially no sulfite ion. However, there can be used physical methods such as a method wherein the developing solution is not used over a long period of time to prevent the developing solution from being deteriorated, a method wherein a floating cover is used to prevent the developing solution from being oxidized by air and a method wherein the degree of opening (open area) of the developing bath is reduced, or chemical methods such as a method wherein the temperature of the developing solution is controlled or a method wherein organic preservatives are added. Among them, the method wherein organic preservatives are added is preferred from the viewpoint of simplification.

The term "organic preservative" as used herein refers to all organic compounds having a function capable of reducing the deterioration rate of aromatic primary amine color developing agents when added to processing solutions for color photographic materials. Namely, the organic preservatives are organic compounds having a function capable of preventing the color developing agents from being oxidized by air, etc. Among these organic compounds, particularly effective organic preservatives include hydroxylamine derivatives (excluding hydroxylamine), hydroxamic acids, hydrazines, hydrazides, phenols, α-hydroxyketones, u-aminoketones, saccharides, monoamines, diamines, polyamines, quaternary ammonium salts, nitroxyl radicals, alcohols, oximes, diamide compounds and condensed cyclic amines. These organic preservatives are described in JP-A Nos. 63-4235, 63-30845, 63-21647, 63-44655, 63-53551, 63-43140, 63-56654, 63-58346, 63-43138, 63-44657, and JP-A No. 63-44656, European Patent No. 254280A, U.S. Pat. Nos. 3,615,503 and 2,494,903, JP-A No. 52-143020 and JP-B No. 48-30496 (the term "JP-B" as used herein means an "examined Japanese patent publication").

The above-described preferred organic preservatives are illustrated in more detail below by referring to specific compounds and general formulas thereof, but the compounds of the present invention are not limited thereto.

The organic preservative compounds described below are added to color developing solutions in such an amount as to give a concentration of 0.005 to 0.5 mol/l, preferably 0.03 to 0.1 mol/l.

It is preferred to add hydroxylamine derivatives and/or hydrazine derivatives in particular.

Hydroxylamine derivatives represented by formula (I) are preferred as organic preservatives.

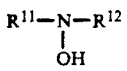

(I)

In formula (I), $R^{11}$ and $R^{12}$ each represents a hydrogen atom, an unsubstituted or substituted alkyl group, an unsubstituted or substituted alkenyl group, an unsubstituted or substituted aryl group (preferably having 6 to 12 carbon atoms and more preferably 6 to 10 carbon atoms) or a heterocyclic group. At least one of $R^{11}$ and $R^{12}$ is always a group other than a hydrogen atom, and $R^{11}$ and $R^{12}$ may be combined together to form a heterocyclic ring. The heterocyclic ring is a five-membered or six-membered ring, may be composed of a carbon atom, hydrogen atom, halogen atom, oxygen atom, nitrogen atom, sulfur atom, etc. and may be saturated or unsaturated.

Compounds where $R^{11}$ and $R^{12}$ are each an alkyl group or an alkenyl group are preferred. These groups have preferably 1 to 10 carbon atoms, particularly preferably 1 to 5 carbon atoms. When $R^{11}$ and $R^{12}$ are combined together to form a nitrogen-containing heterocyclic ring, examples of nitrogen-containing heterocyclic rings include a piperidyl group, a pyrrolidyl group, an N-alkylpiperazyl group, a morpholinyl group, an indolinyl group and a benztriazole group.

Preferred examples of substituent groups for $R^{11}$ and $R^{12}$ include a hydroxyl group, an alkoxy group, an alkyl- or arylsulfonyl group, an amido group, a carboxyl group, a cyano group, a sulfo group, a nitro group and an amino group.

Examples of the hydroxylamine derivatives include the following compounds.

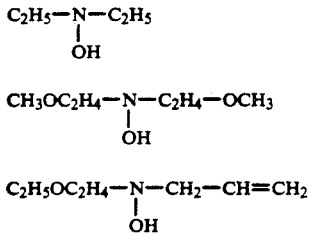

I-1

I-2

I-3

-continued

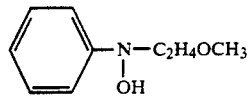

I-4

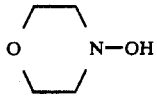

I-5

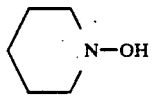

I-6

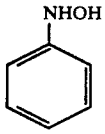

I-7

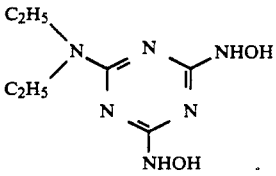

I-8

The following compounds are preferred as hydrazines and hydrazides.

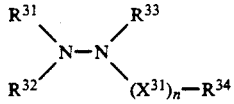

(II)

In formula (II), $R^{31}$, $R^{32}$ and $R^{33}$ represent each hydrogen atom, a substituted or unsubstituted alkyl group (preferably having 1 to 20 carbon atoms), a substituted or unsubstituted aryl group (preferably having 6 to 20 carbon atoms) or a substituted or unsubstituted heterocyclic group (preferably having 1 to 20 carbon atoms and preferably 5- to 6-membered ring); $R^{34}$ represents a hydroxyl group, a hydroxyamino group, a substituted or unsubstituted alkyl group (preferably having 6 to 20 carbon atoms), a substituted or unsubstituted aryl group (preferably having 6 to 20 carbon atoms), a substituted or unsubstituted heterocyclic group (preferably having 1 to 20 carbon atoms), a substituted or unsubstituted alkoxy group (preferably having 1 to 20 carbon atoms), a substituted or unsubstituted aryloxy group (preferably having 6 to 20 carbon atoms), a substituted or unsubstituted carbamoyl group (preferably having 1 to 20 carbon atoms) or a substituted or unsubstituted amino group (preferably having 0 to 20 carbon atoms). The heterocyclic group is a five-membered or six-membered ring, is composed of C, H, O, N, S and/or halogen atoms and may be saturated or unsaturated. $X^{31}$ represents a bivalent group selected from the group consisting of —CO—, —$SO_2$— and

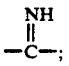

and n represents 0 or 1. When n is 0, $R^{34}$ is a group selected from the group consisting of an alkyl group, an aryl group and a heterocyclic group and $R^{33}$ and $R^{34}$ may be combined together to form a heterocyclic ring.

Compounds having formula (II) where $R^{31}$, $R^{32}$ and $R^{33}$ are each a hydrogen atom or an alkyl group having 1 to 10 carbon atoms are more preferred, and the compounds where $R_{31}$ and $R_{32}$ are each hydrogen atom are particularly preferred.

In formula (II), $R^{34}$ is preferably an alkyl group, an aryl group, an alkoxy group, a carbamoyl group or an amino group. It is particularly preferred that $R^{34}$ is an unsubstituted alkyl group or a substituted alkyl group. Preferred examples of substituent groups for the alkyl group include a carboxyl group, a sulfo group, a nitro group, an amino group and a phosphono group. $X^{31}$ is preferably —CO— or —$SO_2$—, with —CO— being most preferred.

Examples of hydrazines and hydrazides of formula (II) include the following compounds.

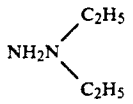
II-1

$NH_2NH(CH_2)_4SO_3H$ II-2

$NH_2NH(CH_2)_2OH$ II-3

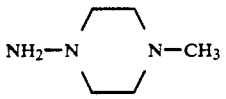
II-4

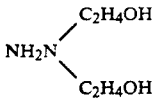
II-5

$NH_2NHCOCH_3$ II-6

$NH_2NHCOOC_2H_5$ II-7

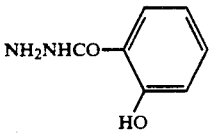
II-8

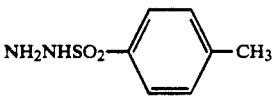
II-9

$NH_2NHCONH_2$ II-10

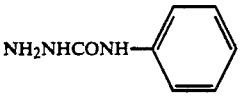
II-11

$NH_2NHSO_3H$ II-12

$NH_2NHC(=NH)NH_2$ II-13

$NH_2NHCOCONHNH_2$ II-14

$NH_2NHCH_2CH_2CH_2SO_3H$ II-15

-continued

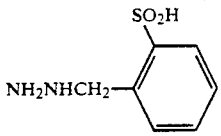
II-16

$NH_2NHCH(C_4H_9(n))COOH$ II-17

$NH_2NHCH_2CH_2COOH$ II-18

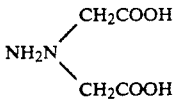
II-19

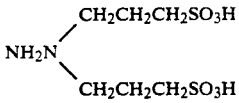
II-20

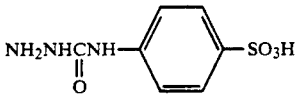
II-21

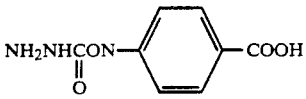
II-22

It is preferred from the viewpoint of improving the stability of color developing solutions, and consequently for improving stability during continuous processing that the compounds represented by formula (I) or (II) are used in combination with amines represented by formula (III) or (IV).

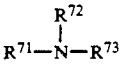
(III)

In formula (III), $R^{71}$, $R^{72}$ and $R^{73}$ each represents a hydrogen atom, an alkyl group (preferably having 1 to 10 carbon atoms), an alkenyl group (preferably having 1 to 10 carbon atoms), an aryl group (preferably having 6 to 12 carbon atoms), an aralkyl group (preferably having 1 to carbon atoms) or a heterocyclic group. $R^{71}$ and $R^{72}$, $R^{71}$ and $R^{73}$ or $R^{72}$ and $R^{73}$ may be combined together to form a nitrogen-containing heterocyclic ring.

$R^{71}$, $R^{72}$ and $R^{73}$ may have one or more substituent groups. $R^{71}$, $R^{72}$ and $R^{73}$ are preferably a hydrogen atom or an alkyl group. Examples of the substituent groups include a hydroxyl group, a sulfo group, a carboxyl group, a halogen atom, a nitro group and an amino group.

Examples of amines having the formula (III) include the following compounds.

$N(CH_2CH_2OH)_3$ III-1

$H_2NCH_2CH_2OH$ III-2

$HN(CH_2CH_2OH)_2$ III-3

$C_7H_{15}N(CH_2CH(OH)CH_2OH)_2$ III-4

-continued

III-5 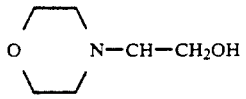

III-6 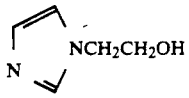

III-7 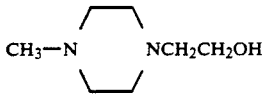

III-8 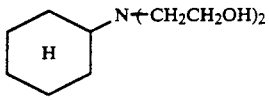

III-9 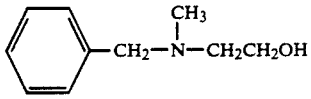

III-10 $(HOCH_2CH_2)_2NCH_2CH_2SO_2CH_3$

III-11 $NH(CH_2COOH)_2$

III-12 $HOOCCH_2CH_2CH(NH_2)COOH$

III-13 $H_2NCH_2CH_2SO_2NH_2$

III-14 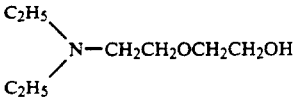

III-15 $H_2N-C(CH_2OH)_2$

III-16 $HOCH_2CH(NH_2)COOH$

III-17 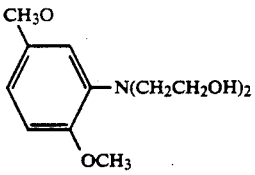

III-18 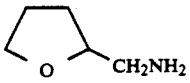

III-19 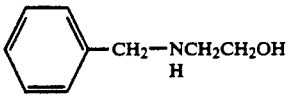

III-20 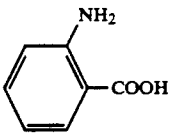

-continued

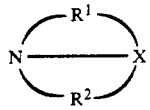

(IV)

In formula (IV), X represents a trivalent atomic group required for the formation of a condensed ring; and $R^1$ and $R^2$ may be the same or different groups and each is an alkylene group, an arylene group, an alkenylene group or an aralkylene group.

Among compounds having formula (IV), compounds represented by formulas (IV-a) and (IV-b) are particularly preferred.

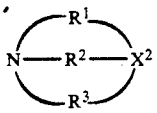

(IV-a)

In the formula, $X^2$ is

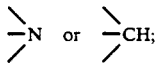

$R^1$ and $R^2$ are the same as those set forth in the formula (IV); and $R^3$ has the same meaning as $R^1$ and $R^2$ of formula (IV) or a group of

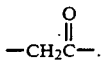

Among compounds having formula (IV-a), compounds where $R^1$, $R^2$ and $R^3$ have not more than 6 carbon atoms are preferred. Compounds where $R^1$, $R^2$ and $R^3$ have not more than 3 carbon atoms are more preferred, and compounds where $R^1$, $R^2$ and $R^3$ have 2 carbon atoms are most Compounds where $R^1$, $R^2$ and $R^3$ are each an alkylene group or an arylene group are preferred. Compounds where $R^1$, $R^2$ and $R^3$ are each an alkylene group are particularly preferred.

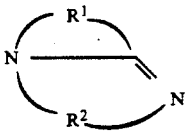

(IV-b)

In formula, $R^1$ and $R^2$ are the same as those set forth in formula (IV).

Among compounds having formula (IV-b), compounds where $R^1$ and $R^2$ have not more than 6 carbon atoms are preferred. More specifically, compounds where $R^1$ and $R^2$ are each an alkylene group or an arylene group are preferred. There are particularly preferred the compounds where $R^1$ and $R^2$ are each an alkylene group.

Among compounds having formulas (IV-a) and (IV-b), compounds having formula (IV-a) are particularly preferred.

Examples of the amines include the following compounds.

IV-1

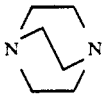

IV-2

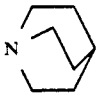

IV-3

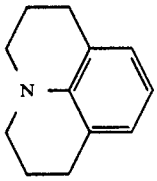

IV-4

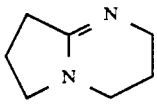

IV-5

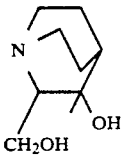

IV-6

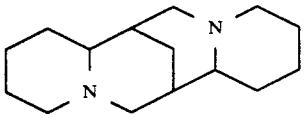

IV-7

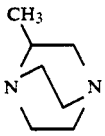

IV-8

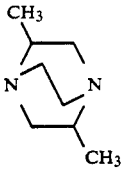

IV-9

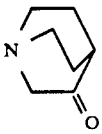

IV-10

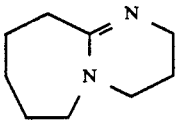

IV-11

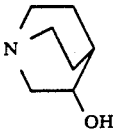

-continued

IV-12

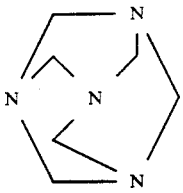

IV-13

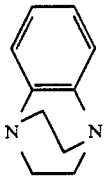

IV-14

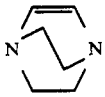

IV-15

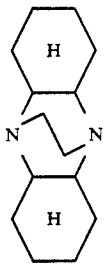

IV-16

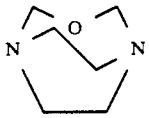

IV-17

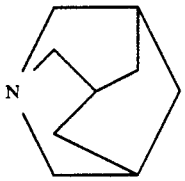

IV-18

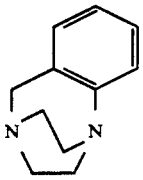

The above-described organic preservatives are commercially available, or can be synthesized according to the methods described in JP-A No. 63-170642 and European Patent Application No. 266797A.

Color developing solutions which can be used in the present invention will be illustrated in more detail below.

The color developing solutions of the present invention contain well-known aromatic primary amine developing agents. Preferred examples thereof are p-phenylenediamines. Typical examples of the developing agents include, but are not limited to, the following compounds.

D-1: N,N-Diethyne-p-phenylenediamine

D-2: 4-[N-Ethyl-N-(β-hydroxyethyl)-amino]aniline

D-3 2 Methyl-4-[N-ethyl-N-(β-hydroxyethyl)amino]-aniline

D-4: 4-Amino-3-methyl-N-ethyl-N-(β-methanesulfonamidoethyl)aniline

The p-phenylenediamines may be in the form of a salt such as sulfate, hydrochloride or p-toluenesulfonate. The aromatic primary amine developing agents are used in an amount of preferably about 0.1 g to 20 g, more preferably about 0.5 g to about 10 g per one liter of the developing solution.

The pH of the color developing solutions of the present invention is in the range of preferably 9 to 12, more preferably 9 to 11.0. The color developing solutions of the present invention may contain other compounds which are conventionally used for developing solutions.

Preferably, buffering agents are used to retain the pH within the range described above. Examples of suitable buffering agents include sodium carbonate, potassium carbonate, sodium bicarbonate, potassium bicarbonate, sodium tertiary phosphate, potassium tertiary phosphate, disodium hydrogenphosphate, dipotassium hydrogenphosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The amount of the buffering agent to be added to the color developing solution is preferably not less than 0.1 mol/l, more preferably 0.1 to 0.4 mol/l.

The color developing solutions may contain various chelating agents as anti-precipitation agents to prevent calcium or magnesium from being precipitated or to improve the stability of the color developing solutions.

Examples of the chelating agents include, but are not limited to, nitrilotriacetic acid, diethylenetriaminepentaacetic acid, ethylenediaminetetraacetic acid, triethylenetetraminehexaacetic acid, N,N,N-trimethylenephosphonic acid, ethylenediamine-N,N,N',N'-tetramethylenephosphonic acid, 1,3-diamino-2-propanoltetraacetic acid, trans-cyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-ortho-hydroxyphenylacetic acid, butane-1,2,4-tricarboxylic acid, 1-hydroxyethylidene-1,1-diphosphonic acid, N,N'-bis(2-hydroxybenzyl)ethylenediamine-N,N--diacetic acid, catechol-3,4,6-trisulfonic acid, catechol-3,5-disulfonic acid, 5-sulfosalicylic acid and 4-sulfosalicylic acid.

These chelating agents may be used either alone or in a combination of two or more of them.

These chelating agents can be used in a sufficient amount to sequester metal ions in the color developing solutions. For example, these chelating agents are used in an amount of 0.01 to 10 g per one liter.

If desired, the color developing solutions may contain development accelerators.

Examples of development accelerators include thioether compounds described in JP-B Nos. 37-16088, 37-5987, 38-7826, 44-12380, 45-9019 and U.S. Pat. No. 3,813,247; p-phenylenediamine compounds described in JP-A Nos. 52-49829 and 50-15554; quaternary ammonium salts described in JP-A No. 50-137726, JP-B No. 44-30774, JP-A No. 56-156826 and JP-A No. 52-43429; p-aminophenols described in U.S. Pat. Nos. 2,610,122 and 4,119,462; amine compounds described in U.S. Pat. Nos. 2,494,903, 3,128,182, 4,230,796 and 3,253,919, JP-B No. 41-11431, U.S. Pat. Nos. 2,482,546, 2,596,926 and 3,582,346; polyalkylene oxides described in JP-B Nos. 37-16088, 42-25201, U.S. Pat. No. 3,128,183, JP-B Nos. 41-11431, 42,23883 and U.S. Pat. No. 3,532,501; and 1-phenyl-3-pyrazolidones, hydrazines, meso-ionic compounds, ionic compounds and imidazoles.

It is preferred that the color developing solutions contain substantially no benzyl alcohol. The term "containing substantially no benzyl alcohol" as used herein means that the color developing solutions contain not more than 2.0 ml of benzyl alcohol per one liter of the developing solution, and preferably are perfectly free from benzyl alcohol. When the developing solutions are free from benzyl alcohol, fluctuation in photographic characteristics is scarcely caused and more preferable results can be obtained.

If desired, anti-fogging agents in addition to chlorine ion and bromine ion may be optionally added. Alkali metal halides such as potassium iodide and organic anti-fogging agents can be used as the anti-fogging agents. Examples of the organic anti-fogging agents include nitrogen-containing heterocyclic compounds such as benztriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, adenine and the following compounds.

IV-3

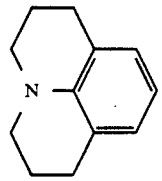

IV-4

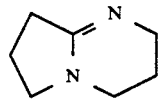

IV-5

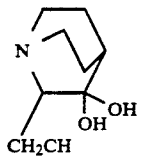

IV-6

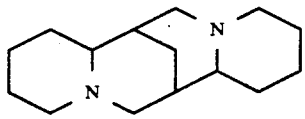

It is preferred that the color developing solutions of the present invention contain a fluorescent brightener. Preferred examples of the fluorescent brighteners are 4,4'-diamino-2,2'-disulfostilbene compounds. The fluorescent brighteners are used in an amount of 0 to 10 g/l, preferably 0.1 to 6 g/l.

If desired, surfactants such as alkylsulfonic acids, arylsulfonic acids, aliphatic carboxylic acids and aromatic carboxylic acids may be added to the color developing solution.

The processing temperature of the color developing solutions is 20° to 50° C., preferably 30° to 40° C., and the processing time is 20 seconds to 5 minutes, preferably 30 seconds to 2 minutes.

Generally, the developing solutions are replenished in the color development. The replenishment rate (i.e., the required amount of replenisher varies depending on the types of photographic materials to be processed, but is generally in the range of 180 to 1,000 per $m^2$ of the photographic material. The replenishment is carried out as a means for constantly retaining the composition of ingredients in the color developing solution to prevent photographic characteristics in the finish of development from being changed by a change in the concentrations of the ingredients in carrying out development by continuously processing a large number of photographic materials with an automatic developing solution. However, the replenishment generates a large amount of overflow solution. Thus, it is preferred that the replenishment rate is small from the viewpoints of reducing cost and preventing environmental pollution. A preferred replenishment rate is 20 to 150 ml per $m^2$ of the photographic material. Though the replenishment rate somewhat varies depending on the types of photographic materials, a replenishment rate of 20 ml per $m^2$ of the photographic material is such an amount that the amount of the developing solution brought over by the photographic material is approximately equal to the amount of replenisher and there is substantially no overflow solution. The present invention is effective in processing photographic materials even with such a low replenishment rate.

A desilverization treatment is carried out after color development in the present invention. The desilvering stage generally comprises a bleaching stage, a bleach-fixing stage and a fixing stage. It is preferred that the bleaching stage and the fixing stage are simultaneously carried out.

Bleaching solutions or bleach-fixing solutions which are used in the present invention may contain rehalogenating agents such as bromides (e.g., potassium bromide, sodium bromide, ammonium bromide), chloride (e.g., potassium chloride, sodium chloride, ammonium chloride) and iodides (e.g., ammonium iodide). If desired, at least one member of inorganic and organic acids having a pH buffering ability such as boric acid, borax, sodium metaborate, acetic acid, sodium acetate, sodium carbonate, potassium carbonate, phosphorous acid, sodium phosphate, citric acid, sodium citrate, tartaric acid and alkali metal salts and ammonium salts thereof or corrosion inhibitors such as ammonium nitrate and guanidine may be added to the bleaching or bleach-fixing solution.

Conventional fixing agents can be used in the bleach-fixing solutions of the present invention or the fixing solutions of the present invention. Examples of the fixing agents include thiosulfates such as sodium thiosulfate and ammonium thiosulfate; thiocyanates such as sodium thiocyanate and ammonium thiocyanate; and water-soluble agents capable of dissolving silver halide such as thioureas and thioether compounds such as ethylenebisthioglycolic acid and 3,6-dithia-1,8-octanediol. These compounds may be used either alone or as a mixture of two or more of them. Further, bleach-fixing solutions composed of a combination of fixing agents described in JP-A No. 55-155354 with a large amount of a halide such as potassium iodide can be used. Thiosulfates, particularly ammonium thiosulfate are preferred in the present invention. The fixing agents are used in an amount of preferably 0.3 to 2 mol/l, more preferably 0.5 to 1.0 mol/l.

The pH of the bleach-fixing solutions or the fixing solutions of the present invention is in the range of preferably 3 to 10, more preferably 5 to 9. When the pH value is lower than the above lower limit, the deterioration of the solutions is accelerated and the conversion of cyan dyes into leuco compounds is accelerated, though desilverization is improved, while when the pH value is higher than the above upper limit, desilverization is retarded and stain is liable to be formed.

If desired, hydrochloric acid, sulfuric acid, nitric acid, acetic acid, bicarbonates, ammonia, potassium hydroxide, sodium hydroxide, sodium carbonate, potassium carbonate, etc. may be added to adjust pH.

The bleach-fixing solutions may contain fluorescent brighteners, defoaming agents surfactants and organic solvents such as methanol and polyvinyl pyrrolidone.

The bleach-fixing solutions or fixing solutions of the present invention contain, as preservatives, compounds capable of releasing a sulfite ion such as sulfites (e.g., sodium sulfite, potassium sulfite, ammonium sulfite, etc.), bisulfites (e.g., ammonium bisulfite, sodium bisulfites, potassium bisulfite, etc.) and metabisulfites (e.g., potassium metabisulfite, sodium metabisulfite, ammonium bisulfite, etc.). These compounds are used in an amount of preferably about 0.02 to 0.50 mol/l, more preferably 0.04 to 0.40 mol/l in terms of sulfite ion.

Generally, sulfites are used as preservatives. In addition thereto, ascorbic acid, carbonyl-bisulfite adducts, sulfinic acids, carbonyl compounds may be added.

Further, buffering agents, fluorescent brighteners, chelating agents, mildewproofing agents, etc. may be added.

The silver halide color photographic materials of the present invention are generally subjected to rinsing and/or stabilizing stages after desilverization by the fixing or bleach-fixing stage.

The amount of rinsing water in the washing stage widely varies depending on the characteristics (e.g., depending on materials used such as couplers) of the photographic materials, use, the temperature of rinsing water, the number of rinsing tanks (the number of stages), replenishing system (countercurrent, cocurrent) and other conditions. The relationship between the amount of water and the number of rinsing tanks in the multi-stage countercurrent system can be determined by the method described in Journal of the Society of Motion Picture and Television Engineers, Vol. 64, p. 248-253 (May 1955).

According to the multi-stage countercurrent system described in the above literature, the amount of rinsing water can be greatly reduced. However, there is caused a problem in that the residence time of the water in the tanks is prolonged and as a result, bacteria grow and the resulting suspended matter is deposited on the photographic material. A method for reducing calcium ion and magnesium ion described in JP-A No. 62-288838 can be effectively used for the color photographic materials of the present invention to solve the above-mentioned problem. Further, isothiazolone compounds, thiabendazole compounds, chlorine-containing germicides such as sodium chlorinated isocyanurate and benztriazole described in JP-A No. 57-8542 and germicides described in *Chemistry of Germicidal Antifungal Agent*, written by Hiroshi Horiguchi, *Sterilization, Disinfection, Antifungal Technique*, edited by Sanitary Technique Society, and *Encyclopedia of Antibacterial and Antifungal Agents*, edited by Nippon Antibacterial Antifungal Society, can be used.

The pH of the rinsing water which can be used in the treatment of the photographic materials of the present invention is in he range of 4 to 9, preferably 5 to 9. The temperature of rinsing water and washing time vary depending on the characteristics of the photographic materials, use, etc., but the temperature and time of washing are generally 15° to 45° C. for 20 seconds to 10 minutes, preferably 25° to 40° C. for 30 seconds to 5 minutes.

The photographic materials of the present invention may be processed directly with stabilizing solutions in place of the rinsing water.

The stabilizing treatment can be carried out by any of the conventional methods described in JP-A Nos. 57-8543, 58-14834, 59-184343, 60-220345, 60-238832, 60-239784, 60-239749, 61-4054 and 61-118749. Particularly, stabilizing baths containing 1-hydroxyethylidene-1,1-diphosphonic acid, 5-chloro-2-methyl-4-isothiazoline-3-one, bismuth compounds, ammonium compounds, etc. are preferred.

A stabilizing treatment subsequent to a rinsing may be conducted. The stabilizing treatment may be used as the final bath for the color photographic materials. An example thereof includes a stabilizing bath containing formalin and a surfactant.

The processing time of the present invention is defined by the time taken to leave the final bath (usually, rinsing or stabilizing bath) after the photographic material is brought into contact with the color developing solution. The effect of the present invention is particularly remarkable in a rapid processing stage wherein the processing time is not longer than 4 min 30 sec, preferably 4 minutes or shorter.

Red-sensitive sensitizing dyes represented by the formula (S), which are used in the present invention will be illustrated in more detail below.

$L_1$, $L_2$, $L_3$, $L_4$ and $L_5$ are each a methine group. The methine group may be optionally substituted; for example, by a substituted or unsubstituted alkyl group (e.g., methyl, ethyl), a substituted or unsubstituted aryl group (e.g., phenyl) or a halogen atom (e.g., chlorine, bromine). The methine group may be combined together with another methine group to form a ring. As this ring, a six-membered ring (particularly, an alicyclic ring) is preferred.

$R^1$ and $R^2$ may be the same or different groups and each represents an alkyl group, preferably an unsubstituted alkyl group having not more than 18 carbon atoms (e.g., methyl, ethyl, propyl, butyl, pentyl, octyl, decyl, dodecyl, octadecyl) or a substituted alkyl group having not more than 18 carbon atoms. Examples of substituent groups include a carboxyl group, a sulfo group, a cyano group, a halogen atom (e.g., fluorine, chlorine, bromine), a hydroxyl group, an alkoxycarbonyl group having not more than 8 carbon atoms (e.g., methoxycarbonyl, ethoxycarbonyl, phenoxycarbonyl, benzyloxycarbonyl), an alkoxy group having not more than 8 carbon atoms (e.g., methoxy, ethoxy, benzyloxy, phenethyloxy), a monocyclic aryloxy group having not more than 10 carbon atoms (e.g., phenoxy, p-tolyloxy), an acyloxy group having not more than 3 carbon atoms, an acyl group having not more than 8 carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) and an aryl group having not more than 10 carbon atoms (e.g., phenyl, 4-chlorophenyl, 4-methylphenyl, naphthyl).

An unsubstituted alkyl group (e.g., methyl, ethyl, pentyl) and a sulfoalkyl group (e.g., 2-sulfoethyl, 3-sulfopropyl, 4-sulfobutyl) are particularly preferred.

$R_1$ and $L_1$ and/or $R_2$ and $L_5$ may be combined together to form a five membered or six-membered carbon ring.

$V_1$, $V_2$, $V_3$, $V_4$, $V_5$, $V_6$, $V_7$ and $V_8$ are each a hydrogen atom, a halogen atom (e.g., chlorine, fluorine, bromine), an unsubstituted alkyl group, preferably an unsubstituted alkyl group having not more than 10 carbon atoms (e.g., methyl, ethyl), a substituted alkyl group, preferably a substituted alkyl group having not more than 18 carbon atoms (e.g., benzoyl, u-naphylmethyl, 2-phenylethyl, trifluoromethyl), an acyl group, preferably an acyl group having not more than 10 carbon atoms (e.g., acetyl, benzoyl, mesyl), an acyloxy group, preferably an acyloxy group having not more than 10 carbon atoms (e.g., acetyloxy), an alkoxycarbonyl group, preferably an alkoxycarbonyl group having not more than 10 carbon atoms (e.g., methoxycarbonyl, ethoxycarbonyl, benzyloxycarbonyl), a substituted or unsubstituted carbamoyl group (e.g., carbamoyl, N,N-dimethylcarbamoyl, morpholino carbonyl, piperidinocarbonyl), a substituted or unsubstituted sulfamoyl group (e.g., sulfamoyl, N,N-dimethylsulfamoyl, morpholinosulfonyl, piperidinosulfonyl), a carboxyl group, a cyano group, a hydroxyl group, an amino group, an acylamino group, preferably an acylamino group having not more than 8 carbon atoms (e.g., acetylamino), an alkoxy group, preferably an alkoxy group having not more than 10 carbon atoms (e.g., methoxy, ethoxy, benzyloxy), an alkylthio group (e.g., ethylthio), an alkylsulfonyl group (e.g., methylsulfonyl), a sulfo group, an aryloxy group (e.g., phenoxy) or an aryl group (e.g., phenyl, tolyl). Among $V_1$ to $V_8$, two groups attached to adjacent carbon atoms may be combined together to form a condensed ring. Examples of condensed rings include a benzene ring and heterocyclic rings (e.g., pyrrole, thiophene, furan, pyridine, imidazole, triazole, thiazole).

$(X_1)_{n1}$ is included in the formula to show the presence or absence of a cation or an anion when the ionic charge of the dye is to be made neutral. Hence, $n_1$ is a proper number which is not smaller than 0 as the occasion demands. Whether a dye is a cation or an anion, or has a net ionic charge or not, varies depending on the auxochrome and substituent group of the dye. Counter ion $(X_1)n_1$ can be easily exchanged after the production of the dyes. Typical cations are inorganic or organic ammonium ions and alkali metal ions. Anions may be any of inorganic anions and organic anions. Examples of the anions include halogen anions (e.g., fluorine ion, chlorine ion, bromine ion, iodine ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. A preferred anion is iodine ion.

Among the red-sensitive sensitizing dyes represented by formula (S), red-sensitive sensitizing dyes represented by formulas (S-I) and (S-II) are preferred. Among them, the red-sensitive sensitizing dyes having formula (S-I) are particularly preferred.

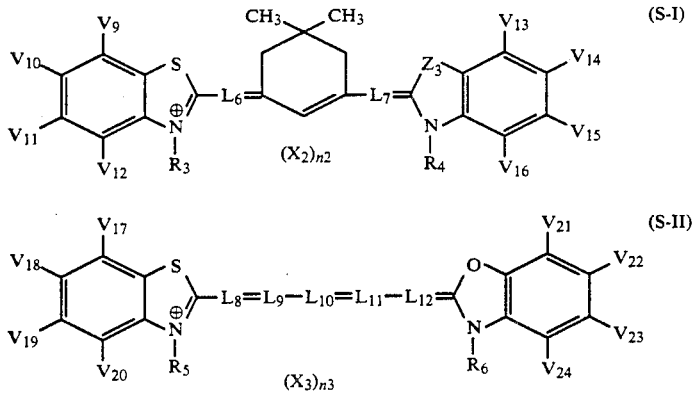

(S-I)

(S-II)

In formula (S-I), $Z_3$ represents an oxygen atom or sulfur atom.

$L_6$ and $L_7$ represent each a methine group.

$R_3$ and $R_4$ are the same as those set forth in the definitions of $R_1$ and $R_2$ in formula (S). $R_3$ and $L_6$ or $R_4$ and $L_7$ may be combined together to form a five-membered or six-membered carbon ring.

$V_9$, $V_{10}$, $V_{11}$, $V_{12}$, $V_{13}$, $V_{14}$, $V_{15}$ and $V_{16}$ represent each a hydrogen atom or substituent groups already described above in the definitions of $V_1$, $V_2$, $V_3$, $V_4$, $V_5$, $V_6$, $V_7$ and $V_8$ in formula (S). It is preferred that among $V_9$ to $V_{16}$, two groups attached to adjacent carbon atom can not be combined together to form a condensed ring. In the case where each Hammett's $\sigma_p$ value is referred to as $\sigma_{pi}(i=9—16)$ and $Y=\sigma_{p9}+\sigma_{p10}+\sigma_{p11}+\sigma_{p12}+\sigma_{p12}+\sigma_{p13}+\sigma_{p14}+\sigma_{p15}+\sigma_{p16}$, it is preferred that $Y \leqq -0.08$ when $Z_3$ is an oxygen atom, while when $Z_3$ is a sulfur atom, it is preferred that $Y \leqq -0.15$. More preferably, $Y \leqq -0.15$ when $Z_3$ is an oxygen atom, while when $Z_3$ is a sulfur atom, $Y \leqq -0.30$. Particularly preferably, $-0.90 \leqq Y \leqq -0.17$ when $Z_3$ is an oxygen atom, while when $Z_3$ is sulfur atom, $-1.05 \leqq Y \leqq -0.34$.

$\sigma_p$ is a value described in *Guide to Structural Activity Correlation of Drugs-Drug Design*, pages 96-103, in Chemical Area, extra No. 122, edited by Structural Activity Correlation Gathering Meeting, published by Nankodo (written in Japanese), and Corwin Hansch and Albert Leo, *Substituent Constants for Correlation Analysis in Chemistry and Biology*, pages 69-161 (John Wiley and Sons). Methods for measuring $\sigma_p$ are described in Chemical Reviews, Vol. 17, pages 125-136 (1935). $V_9$, $V_{10}$, $V_{11}$, $V_{12}$, $V_{13}$, $V_{14}$, $V_{15}$ and $V_{16}$ preferably are each a hydrogen atom, an unsubstituted alkyl group having not more than 6 carbon atoms (e.g., methyl, ethyl, n-propyl, isopropyl, n-butyl, t-butyl, pentyl, cyclopropyl, cyclobutyl, cyclopentyl, cyclohexyl), a substituted alkyl group having not more than 8 carbon atoms (e.g., carboxymethyl, 2-carboxyethyl, benzyl, phenethyl, dimethylaminopropyl), a hydroxyl group, an amino group (e.g., amino, hydroxyamino, methylamino, dimethylamino, diphenylamino), an alkoxy group (e.g., methoxy, ethoxy, isopropoxy, propoxy, butoxy, pentoxy), an aryloxy group (e.g., phenoxy) or an aryl group (e.g., phenyl).

$(X_2)_{n2}$ has the same meaning as $(X_1)_{n1}$ in formula (S).

In formula (S-II), $L_8$, $L_9$, $L_{10}$, $L_{11}$ and $L_{12}$ are the same as those set forth in the definitions of $L_1$, $L_2$, $L_3$, $L_4$ and $L_5$ in formula (S). Preferably, these groups are methine group substituted by a substituent group wherein the Hammett's $\sigma_p$ value thereof is negative. Examples of substituent groups include a substituted alkyl group and an unsubstituted alkyl group (e.g., methyl, ethyl).

Preferably, $L_9$ and $L_{11}$ may be combined together to form a five membered or six-membered carbon ring.

$R_5$ and $R_6$ are the same as those set forth in the definitions of $R_1$ and $R_2$ in formula (S).

With regard to $V_{17}$, $V_{18}$, $V_{19}$, $V_{20}$, $V_{21}$, $V_{22}$, $V_{23}$ and $V_{24}$, at least one pair of two groups attached to adjacent carbon atoms are combined together to form a benzene ring or a heterocyclic ring (e.g., pyrrole, thiophene, furan, pyridine, imidazole, triazole, thiazole). These rings may be further substituted.

The $V_{17}$ to $V_{24}$ groups which do not participate in the formation of the benzene ring or the heterocyclic ring, are the same as those set forth in the definitions of $V_1$ to $V_8$ in formula (S).

$(X_3)_{n3}$ has the same meaning as $(X_1)_{n1}$ in formula (S).

Examples of the dyes represented by the formulas (S), (S-I) and (S-II) include, but are not limited to, the following compounds.

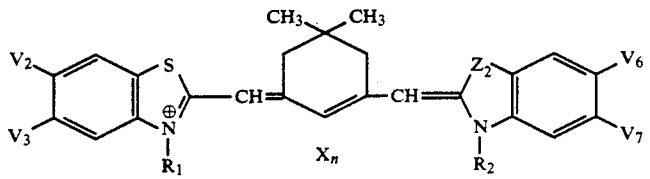

| | $Z_2$ | $R_1$ | $R_2$ | $V_2$ | $V_3$ | $V_6$ | $V_7$ | X | n |
|---|---|---|---|---|---|---|---|---|---|
| S-1 | S | $CH_3CH_2$ | $CH_3CH_2$ | H | H | H | H | $I^{\ominus}$ | 1 |
| S-2 | " | " | " | $CH_3$ | $CH_3$ | H | H | " | " |
| S-3 | " | " | " | $CH_3$ | H | $CH_3$ | H | " | " |
| S-4 | " | " | " | $CH_3$ | H | H | $CH_3$ | " | " |
| S-5 | " | " | " | H | $CH_3$ | H | $CH_3$ | " | " |
| S-6 | " | " | " | H | $CH_3O$ | H | H | " | " |
| S-7 | S | $CH_3CH_2$ | $CH_3CH_2$ | $CH_3O$ | $CH_3O$ | H | H | $I^{\ominus}$ | 1 |
| S-8 | " | " | " | $CH_3O$ | H | $CH_3O$ | H | " | " |
| S-9 | " | " | " | $CH_3O$ | H | H | $CH_3O$ | " | " |
| S-10 | " | " | " | H | $CH_3O$ | H | $CH_3O$ | " | " |
| S-11 | " | " | " | $CH_3$ | $CH_3$ | $CH_3$ | $CH_3$ | " | " |
| S-12 | " | " | " | $CH_3O$ | $CH_3O$ | $CH_3O$ | $CH_3O$ | " | " |
| S-13 | " | " | " | $CH_3O$ | $CH_3$ | H | H | " | " |
| S-14 | " | " | " | $CH_3CH_2O$ | H | $CH_3CH_2O$ | H | " | " |
| S-15 | " | " | " | $CH_3CH_2$ | H | $CH_3CH_2$ | H | " | " |
| S-16 | S | $CH_3CH_2$ | $CH_3CH_2$ | $CH_3(CH_2)_2$ | H | $CH_3(CH_2)_2$ | H | $I^{\ominus}$ | 1 |
| S-17 | " | " | " | $N(CH_3)_2$ | H | H | H | " | " |
| S-18 | " | $(CH_2)_3SO_3^-$ | " | $CH_3$ | H | $CH_3$ | H | — | — |
| S-19 | " | $(CH_2)_4SO_3^-$ | " | $CH_3$ | H | $CH_3$ | H | — | — |
| S-20 | " | $(CH_2)_3SO_3^-$ | $(CH_2)_3SO_3^-$ | $CH_3$ | H | $CH_3$ | H | $\overset{\oplus}{H}NEt_2$ | 1 |
| S-21 | " | $(CH_2)_4SO_3^-$ | $(CH_2)_4SO_3^-$ | $CH_3$ | H | $CH_3$ | H | 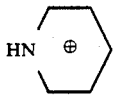 | 1 |
| S-22 | " | $CH_3(CH_2)_4$ | $CH_3CH_2$ | $CH_3$ | H | $CH_3$ | H | $I^{\ominus}$ | 1 |
| S-23 | " | $CH_3(CH_2)_4$ | $(CH_2)_3SO_4^-$ | $CH_3$ | H | $CH_3$ | H | — | — |
| S-24 | " | $CH_3$ | $CH_3$ | $CH_3$ | H | $CH_3$ | H | $I^{\ominus}$ | 1 |
| S-25 | S | $(CH_2)_3SO_4^-$ | $(CH_2)_4SO_4^-$ | $CH_3$ | H | $CH_3$ | H | $\overset{\oplus}{H}NEt_2$ | 1 |
| S-26 | " | $CH_3$ | $CH_3(CH_2)_2$ | $CH_3$ | H | $CH_3$ | H | $I^{\ominus}$ | 1 |
| S-27 | " | $(CH_2)_3SO_3^-$ | $CH_3CH_2$ | $CH_3O$ | $CH_3O$ | H | H | — | — |
| S-28 | " | $CH_3CH_2$ | $(CH_2)_3SO_3^-$ | $CH_3O$ | $CH_3O$ | H | H | — | — |
| S-29 | O | $CH_3CH_2$ | $CH_3CH_2$ | $CH_3$ | H | H | H | $I^{\ominus}$ | 1 |
| S-30 | " | " | " | H | $CH_3$ | H | H | " | " |
| S-31 | " | " | " | $CH_3$ | $CH_3$ | H | H | " | " |
| S-32 | " | " | " | $CH_3$ | H | $CH_3$ | H | " | " |
| S-33 | " | " | " | $CH_3$ | H | H | $CH_3$ | " | " |
| S-34 | " | " | " | H | $CH_3$ | H | $CH_3$ | " | " |

(S-35)

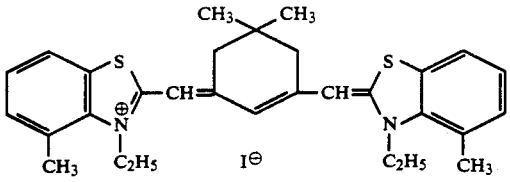

(S-36)

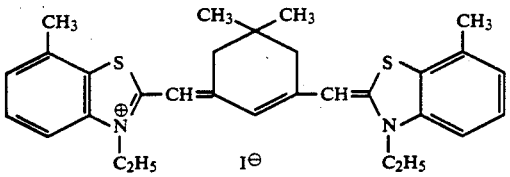

(S-37)

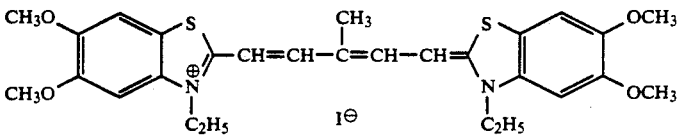

-continued

| | $Z_2$ | $R_1$ | $R_2$ | $V_2$ | $V_3$ | $V_6$ | $V_7$ | X | n |
|---|---|---|---|---|---|---|---|---|---|
| (S-38) | 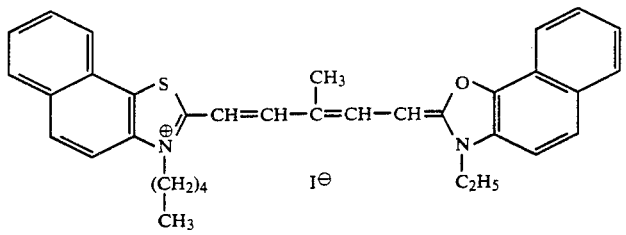 | | | | | | | | |
| (S-39) | 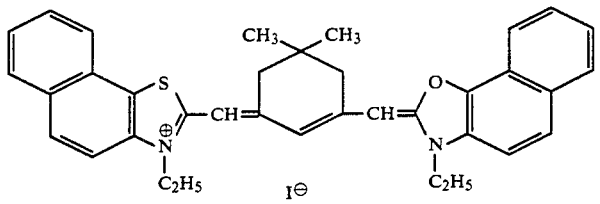 | | | | | | | | |
| (S-40) | 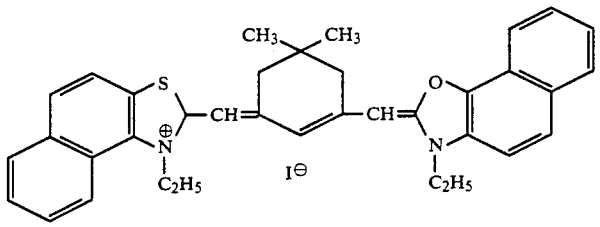 | | | | | | | | |
| (S-41) | 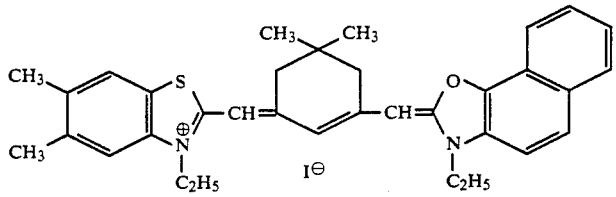 | | | | | | | | |
| (S-42) | 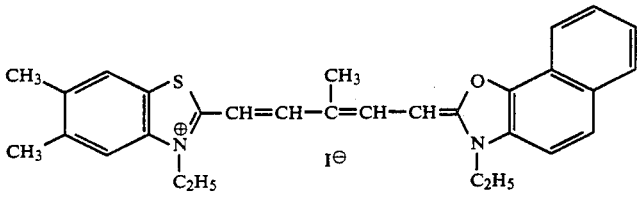 | | | | | | | | |
| (S-43) | 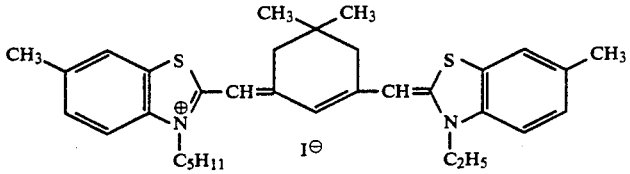 | | | | | | | | |

The dyes having formula (S) can be easily synthesized according to the methods described in F. M. Hamer, *Heterocyclic Compounds-Cyanine Dyes and Related Compounds*, Chapter IX, pages 270–287 (John Wiley and Sons, 1964) and D. M. Sturmer, *Heterocyclic Compounds Special Topics in Heterocyclic Chemistry*, Chapter VIII, sec IV, pages 482–515 (John Wiley and Sons, 1977).

The spectral sensitizing dyes having the formula (S), (S-I) or (S-II) can be incorporated in the silver halide emulsion of the present invention by directly dispersing them in the emulsion or by dissolving them in a solvent such as water, methanol, ethanol, propanol, methyl cellosolve or 2,2,3,3-tetrafluoropropanol alone or in a mixture thereof and adding the resulting solution to the emulsion. An aqueous solution of the dyes in the presence of an acid or a base may be added to the emulsion as described in JP-B Nos. 44-23389, 44-27555 and 57-22089, or an aqueous solution or a colloidal dispersion of the dyes in the presence of a surfactant may be added to the emulsion as described in U.S. Pat. Nos. 3,822,135 and 4,006,025. In addition, after the dyes are dissolved in a water-immiscible solvent such as phenoxyethanol, the resulting solution can be dispersed in water or a hydrophilic colloid and the resulting dispersion may be added to the emulsion. Also, the dyes are directly dispersed in a hydrophilic colloid and then the dispersion may be added to the emulsion as described in JP-A-53-102733 and JP-A-58-105141.

The spectral sensitizing dyes of formula (S), (S-I) or (S-II) may be added to the emulsion at any time during conventional stages of the preparation of the emulsion. Generally, the dyes are added in a stage before coating after the completion of chemical sensitization. The dyes may be added simultaneously with a chemical sensitizing dye, and there may be simultaneously carried out spectral sensitization and chemical sensitization as described in U.S. Pat. Nos. 3,628,969 and 4,225,666. Further, spectral sensitization may be carried out prior to chemical sensitization as described in JP-A No. 58-113928. Also, the dyes may be added before the completion of the formation of silver halide grains and then spectral sensitization may be initiated. Further, the dyes may be added in portions, that is, part of them is added prior to chemical sensitization and the remainder of them is added after chemical sensitization as described in U.S. Pat. No. 4,225,666. The dyes may be added during the course of the formation of silver halide grains as described in U.S. Pat. No. 4,183,756, etc.

The spectral sensitization amounts of the compounds having the formulas (S), (S-I) and (S-II) are in the range of generally about $4\times10^{-6}$ to $8\times10^{-3}$ mol, preferably $1\times10^{-5}$ to $1\times10^{-3}$ mol, more preferably $5\times10^{-5}$ to $5\times10^{-4}$ mol per mol of silver halide in the silver halide emulsion.

It is preferred that the red-sensitive silver halide emulsion layer of the present invention contains a compound represented by formula (T).

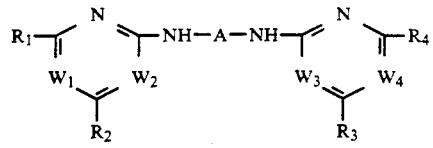

(T)

In formula (T), A represents a bivalent aromatic residue; $R_1$, $R_2$, $R_3$ and $R_4$ each represents a hydrogen atom, a hydroxyl group, an alkyl group, an alkoxy group, an aryloxy group, a halogen atom, a heterocyclic nucleus, a heterocyclic thio group, an arylthio group, an amino group, a substituted or unsubstituted alkylamino group, a substituted or unsubstituted arylamino group, a substituted or unsubstituted aralkylamino group, an aryl group or a mercapto group; at least one of A, $R_1$, $R_2$, $R_3$ and $R_4$ has a sulfo group; and $W_1$, $W_2$, $W_3$ and $W_4$ may be the same or different groups and each represents —CH= or —N=, and either one of $W_1$ and $W_2$ and either one of $W_3$ and $W_4$ are —N=.

Compounds having formula (T) will be illustrated in more detail below.

In formula (T), A is a bivalent aromatic residue which may optionally have a $—SO_3M$ group (which M is hydrogen atom or a cation (e.g., sodium, potassium) which makes the compounds water-soluble).

The following groups $A_1$ and $A_2$ are useful as the group A. When $R_1$, $R_2$, $R_3$ or $R_4$ does not have a $—SO_3M$ group, the group A is selected from among the group $A_1$.

Examples of group A, include the following groups.

$A_1$:

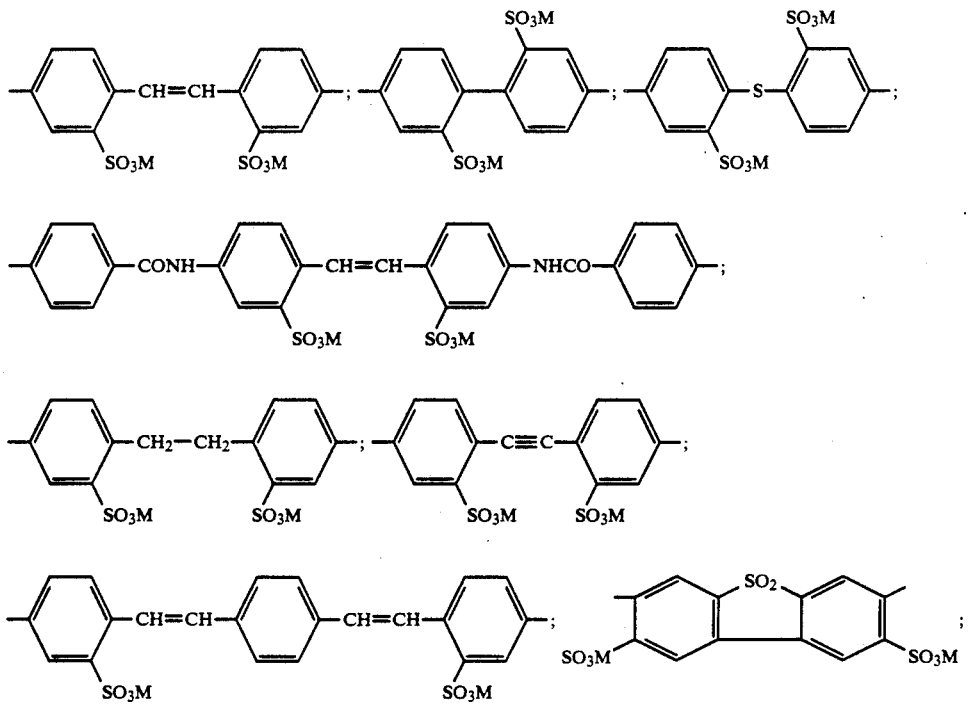

-continued

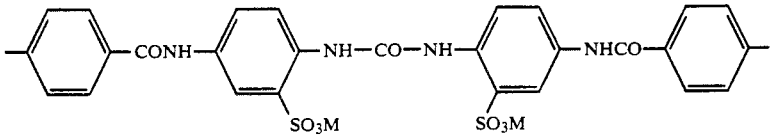

In the formulas, M is a hydrogen atom or a cation which imparts water-solubility.

Examples of the group $A_2$ include the following groups. $A_2$:

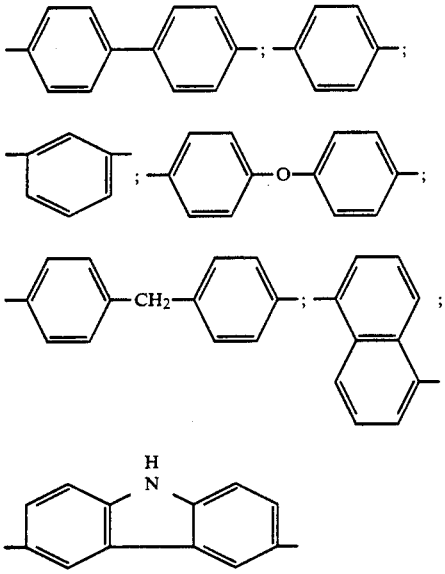

$R_1$, $R_2$, $R_3$ and $R_4$ in formula (T) each represents a hydrogen atom, a hydroxyl group, a lower alkyl group (having preferably 1 to 8 carbon atoms, e.g., methyl, ethyl, n-propyl, n-butyl), an alkoxy group (having preferably 1 to 8 carbon atoms, e.g., methoxy, ethoxy, propoxy, butoxy), an aryloxy group (e.g., an unsubstituted aryloxy group such as phenoxy, naphthoxy, o-tolyloxy and p-sulfophenoxy and an aryloxy group substituted by an alkyl group, an alkoxy group; a sulfo group, a carboxyl group, a halogen atom, an amino group, a hydroxyl group, an acetylamino group or the like), a halogen atom (e.g., chlorine, bromine), a heterocyclic nucleus (e.g., morpholinyl, piperidyl), an alkylthio group (e.g., methylthio, ethylthio), a heterocyclic thio group (e.g., benzthiazolylthio, benzimidazolylthio, phenyltetrazolylthio), an arylthio group (e.g., phenylthio, tolylthio), an amino group, an unsubstituted or substituted alkylamino group (e.g., methylamino, ethylamino, propylamino, dimethylamino, diethylamino, dodecylamino, cyclohexylamino, β-hydroxyethylamino, di-(β-hydroxylethyl)amino, β-sulfoethylamino), an unsubstituted or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclic amino group (e.g., 2-benzthiazolylamino, 2-pyridylamino), a substituted or unsubstituted aralkylamino group (e.g., benzylamino, o-anisylamino, m-anisylamino, p-anisylamino), an aryl group (e.g., phenyl) or a mercapto group. $R_1$, $R_2$, $R_3$ and $R_4$ in formula (T) may be the same or different groups. When the group A is selected from among the group $A_2$, it is necessary that at least one of $R_1$, $R_2$, $R_3$ and $R_4$ has at least one sulfo group (in the free acid or in the form of a salt). $W_1$ to $W_4$ each represents —CH= or —N=, with —CH= being preferred.

Examples of compounds having formula (T) include the following compounds.

(T-1) Disodium salt of 4,4-bis[4,6-di-(benzothiazolyl-2-thio)pyrimidine-2-ylamino]stilbene-2,2'-disulfonic acid (T-2) Disodium salt of 4,4'-bis-[4,6-di(benzothiazolyl-2-amino)-pyrimidine-2-ylamino]stilbene-2,2'-disulfonic acid (T-3) Disodium salt of 4,4'-bis-[2,6-di(naphthyl-2-oxy)-pyrimidine-4-ylamino]stilbene-2,2'-disulfonic acid (T-4) Sodium salt of 4,4'-bis[4,6-di-(naphthyl-2-oxy)-pyrimidine-2-ylamino]-bibenzyl-2,2'-disulfonic acid (T-5) Disodium salt of 4,4'-bis(4,6-dianilino pyrimidine-2-ylamino)-stilbene-2,2'-disulfonic acid (T-6) Disodium salt of 4,4'-bis[4-chloro-6-(2-naphthyloxy)pyrimidine-2-ylamino]biphenyl-2,2'disulfonic acid (T-7) Disodium salt of 4,4'-bis[4,6-di(1-phenyltetrazolyl-5-thio)-pyrimidine-2-ylamino]stilbene-2,2'-disulfonic acid (T-8) Disodium salt of 4,4'-bis[4,6-di(benzimidazolyl-2-thio)pyrimidine-2-ylamino]stilbene-2,2'-disulfonic acid (T-9) Disodium salt of 4,4'-bis(4,6-diphenoxypyrimidine-2-ylamino)-stilbene-2,2'-disulfonic acid (T-10) Disodium salt of 4,4'-bis(4,6-diphenylpyrimidine-2-ylamino)-stilbene-2,2'-disulfonic acid (T-11) Disodium salt of 4,4'-bis(4,6-dimercaptopyrimidine-2-ylamino)biphenyl-2,2'-disulfonic acid (T-12) Disodium salt of 4,4'-bis(4,6-dianilino-triazine-2-ylamino)-stilbene-2,2'-disulfonic acid (T-13) Disodium salt of 4,4'-bis(4-anilino-6-hydroxytriazine-2-ylamino)stilbene-2,2'-disulfonic acid (T-14) Disodium salt of 4,4'-bis(4-naphthylamino-6-anilino-triazine-2-ylamino)stilbene-2,2'-disulfonic acid (T-15) Disodium salt of 4,4'-bis(2,6-dianilinopyrimidine-4-ylamino)-stilbene-2,2'-disulfonic acid (T-16) Disodium salt of 4,4'-bis(2-phenoxy-6-anilinopyrimidine-4-ylamino)stilbene-2,2'-disulfonic acid (T-17) Tetrasodium salt of 4,4'-bis-[2-(6-sulfo-2-naphtylamino)-6-anilino-4-ylamino]stilbene-2,2'-disulfonic acid Among the above exemplified compounds, compounds (T-1) to (T-12) and (T-15) to (T-17) are preferred. Compounds (T-1), (T-2), (T-3), (T-4), (T-5), (T-7), (T-12) and (T-15) to (T-17) are particularly preferred.

Compounds having formula (T) are used in an amount of preferably $1\times10^{-5}$ to $1\times10^{-1}$ mol, more preferably $1\times10^{-4}$ to $1\times10^{-2}$ mol per mol of silver halide emulsion in terms of silver.

It is preferred that the silver halide color photographic material of the present invention contains a sensitizing dye represented by formula (U) in addition to the sensitizing dye having formula (S).

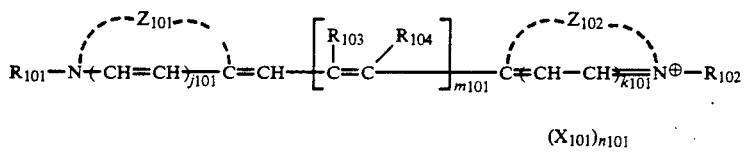

(U)

In formula (U), $Z_{101}$ and $Z_{102}$ each represents an atomic group required for the formation of a heterocyclic nucleus.

As the heterocyclic nucleus, there are preferred five-membered or six-membered nuclei containing a nitrogen atom, a sulfur atom, an oxygen atom, a selenium atom or tellurium atom (these nuclei may have further substituent groups, or a condensed ring may be attached to these nuclei).

Examples of the heterocyclic nuclei include a thiazole nucleus, a benzthiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, an imidazole nucleus, a benzimidazole nucleus, a naphthoimidazole nucleus, a 4-quinoline nucleus, a pyrroline nucleus, a pyridine nucleus, a tetrazole nucleus, an indolenine nucleus, a benzindolenine nucleus, an indole nucleus, a tetrazole nucleus, a benztetrazole nucleus and a naphthotetrazole nucleus.

$R_{101}$ and $R_{102}$ each represents an alkyl group, an alkenyl group, an alkynyl group or an aralkyl group. These groups and groups described hereinafter include both unsubstituted groups and substituted groups. For example, the term "alkyl group" as used herein includes both an unsubstituted alkyl group and a substituted alkyl group. The alkyl group may be straight-chain, branched or cyclic radical. The alkyl group has preferably 1 to 8 carbon atoms.

Examples of substituent groups for the substituted alkyl group include a halogen atom (e.g., chlorine, bromine, fluorine), a cyano group, an alkoxy group, a substituted or unsubstituted amino group, a carboxyl group, a sulfo group and a hydroxyl group. The alkyl group may have one or more substituent group.

An example of the alkenyl group includes a vinyl methyl group.

Examples of the aralkyl group include a benzyl group and a phenethyl group.

$m_{101}$ is an integer of 0, 1, 2 or 3. When $m_{101}$ is 1, $R_{103}$ is a hydrogen atom, a lower alkyl group, an aralkyl group or an aryl group.

Examples of the aryl group include a substituted phenyl group and unsubstituted phenyl group.

$R_{104}$ is hydrogen atom. When $m_{101}$ is 2 Or 3, $R_{103}$ is a hydrogen atom and $R_{104}$ is a hydrogen atom, a lower alkyl group or an aralkyl group or $R_{104}$ may be combined together with $R_{102}$ to form a five-membered or six-membered ring. When $m_{101}$ is 2 or 3 and $R_{104}$ is a hydrogen atom, one $R_{103}$ may be combined together with another $R_{103}$ to form a hydrocarbon ring or a heterocyclic ring. Preferably, these rings are five-membered or six-membered rings. $j_{101}$ and $k_{101}$ represent each 0 or 1; $X_{101}$ represents an acid anion; and $n_{101}$ represents 0 or 1.

Examples of compounds having the formula (U) include, but are not limited to, the following compounds.

U-1

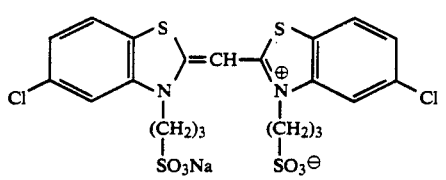

U-2

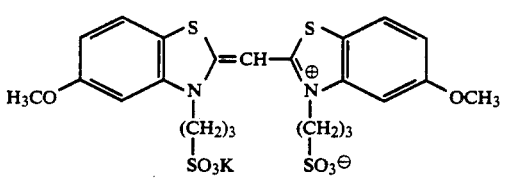

U-3

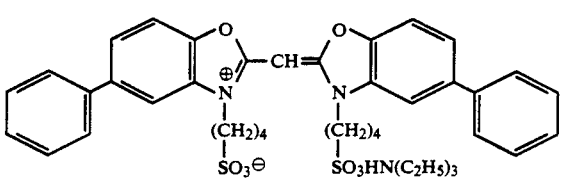

-continued
U-4
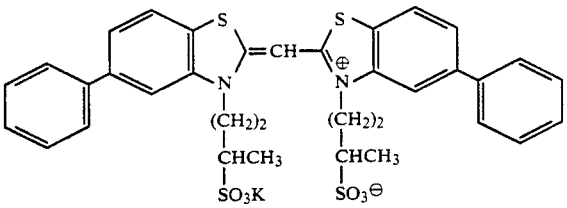
U-5
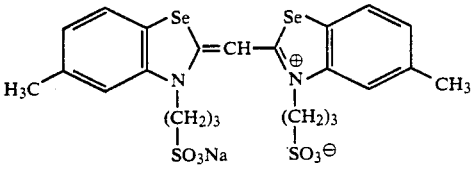
U-6
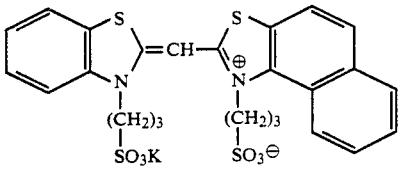
U-7
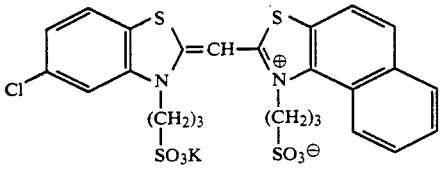
U-8
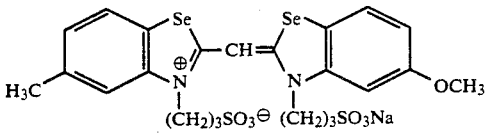
U-9
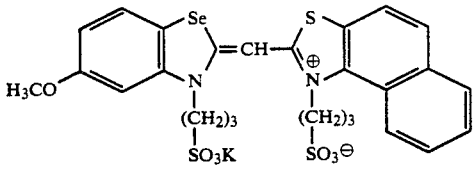
U-10
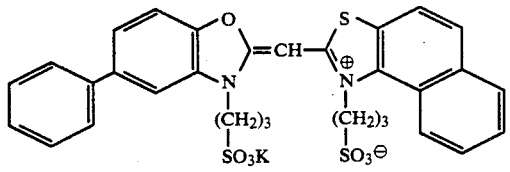
U-11
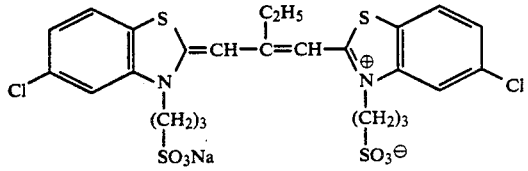

-continued
U-12
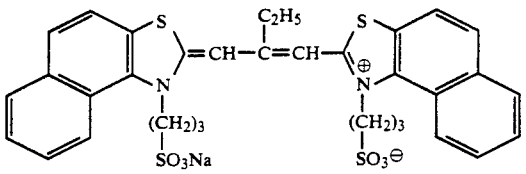
U-13
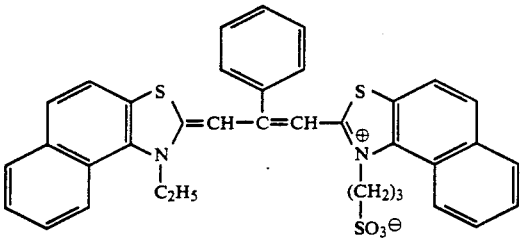
U-14
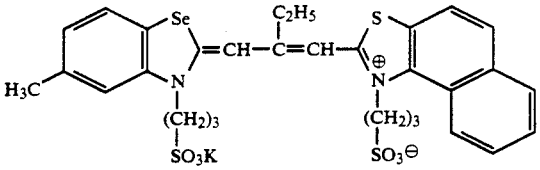
U-15
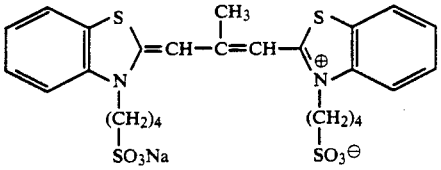
U-16
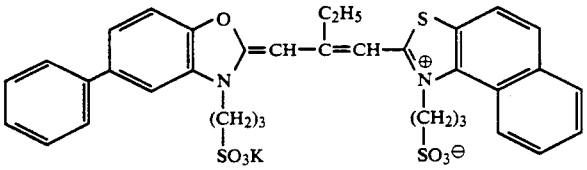
U-17
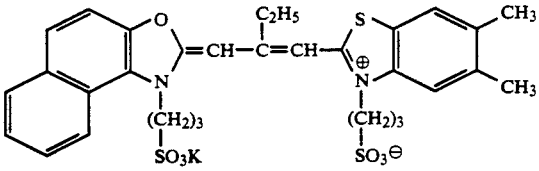
U-18
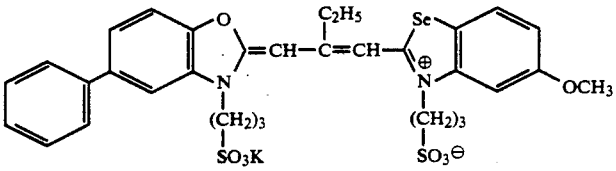
U-19
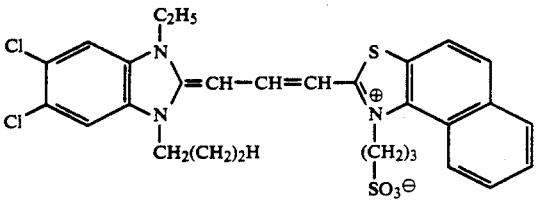

-continued
U-20
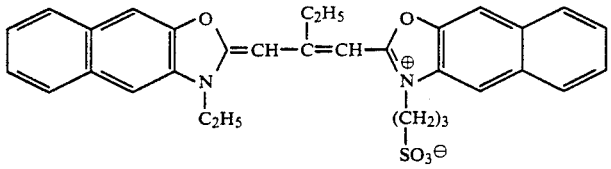
U-21
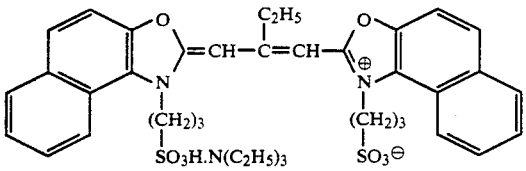
U-22
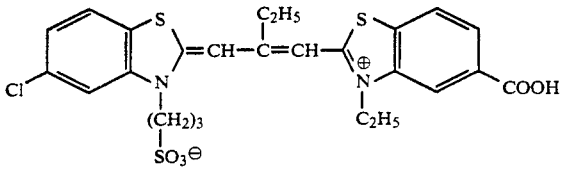
U-23
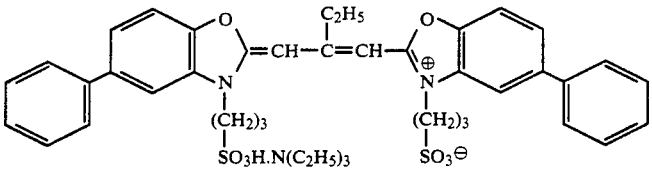
U-24
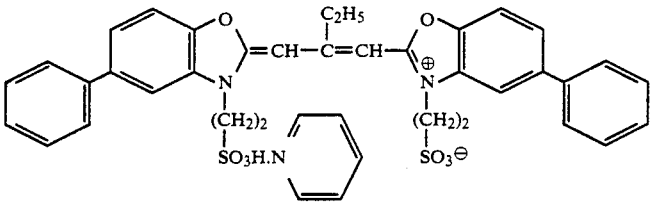
U-25
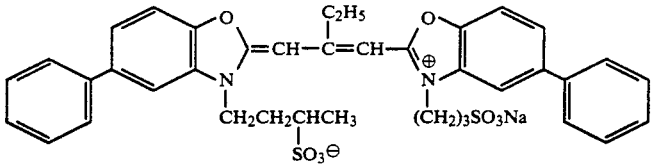
U-26
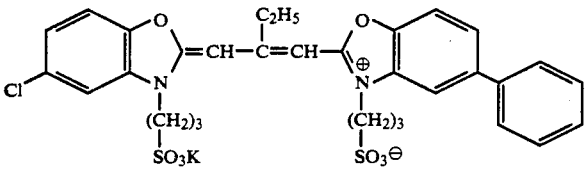
U-27
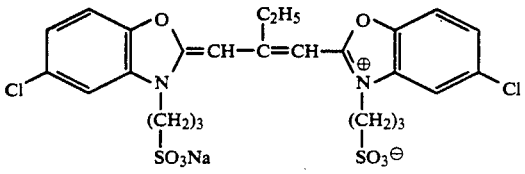

-continued

U-28

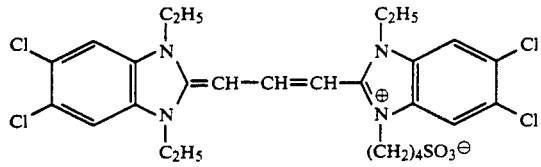

U-29

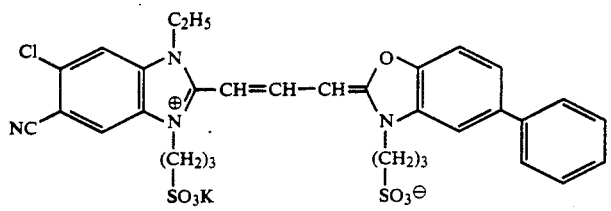

The color photographic material of the present invention can be formed by coating at least one layer of each of a blue-sensitive silver halide emulsion layer, a green-sensitive silver halide emulsion layer and a red-sensitive emulsion layer on a support. Generally, the color photographic paper is formed by coating the above layers in the above order on a support. However, the above layers may be coated in a different order. Dyes having the relation of a complementary color to light sensitive to silver halide emulsions having specific sensitivity at each wave region, that is, a color coupler forming yellow to blue, a color coupler forming magenta to green and a color coupler forming cyan to red are incorporated in these sensitive emulsion layers, whereby color reproduction according to subtractive color photography can be made. However, the relationship between the sensitive layer and the developed hue of the coupler may be different from that described above.

In the present invention, the silver halide emulsion in a layer containing a compound represented by formula (S) has the silver chloride content of at least 80 mol%, preferably 95 mol%, more preferably at least 98 mol% based on the total amount of silver halide. It is preferred from the viewpoint of rapid processing that the content of silver chloride is as high as possible. The high silver chloride of the present invention may contain a small amount of silver bromide or silver iodide. In some cases, by employing a small amount of silver bromide or silver iodide, there are advantages from the viewpoint of photosensitivity that the amount of absorbed light is increased, the adsorption of spectral sensitizing dye is increased or desensitization due to spectral sensitizing dye is reduced. Also, the silver halide emulsion layer containing no compound represented by formula (S) preferably has the silver chloride content of at least 80 mol% on the total amount of silver halide.

Preferably, the high silver halide emulsion has such a structure that silver halide grains have silver bromide-localized phases in a laminar or non-laminar form in the interiors of the grains and/or on the surfaces thereof. The localized phases have such a halogen composition that the silver bromide content thereof is preferably at least 10 mol%, more preferably higher than 20 mol%. The localized phases may exist in the interiors of grains or on the edges, corners or planes of the surfaces of the grains. In a preferred embodiment, the localized phases are formed by epitaxial growth on the corners of the grains.

To prevent sensitivity from being lowered when pressure is applied to the photographic material, it is sometimes preferred to use uniform structure type grains having a narrow halogen composition distribution even when the high silver chloride emulsion having a silver chloride content of not lower than 90 mol% is used.

The silver chloride content of the silver halide emulsion may be further increased to reduce the replenishment rates (i.e., the amount required of replenisher) of developing solutions. In such a case, an approximately pure silver chloride emulsion having a silver chloride content of 98 to 100 mol% is preferred.

Silver halide grains to be incorporated in the silver halide emulsions of the present invention have a mean grain size (the diameter of a circle equal to the projected area of a grain is referred to as the grain size, and the arithmetical mean of the grain sizes is a mean grain size) of preferably 0.2 to 2 $\mu$m.

The grain size distribution preferably is not higher than 20%, preferably not higher than 15% in terms of a coefficient of variation (a value obtained by dividing the standard deviation of grain size by the mean grain size). Namely, monodisperse emulsions are preferred in the present invention. It is also preferred that monodisperse emulsions are blended in the same layer or are multi-coated in different layers for the purpose of obtaining wide latitude.

The silver halide grains of the present invention may have a regular crystalline form such as a cube, tetradecahedron or octahedron, or an irregular crystalline form such as a sphere or tabular (plate form), or a composite form of these crystalline forms. A mixture of grains having various crystalline forms can be used, but it is preferred that grains having such a crystal form distribution that at least 50%, preferably 70%, more preferably 90% thereof is composed of grains having regular crystalline forms.

The silver halide emulsion of the present invention may be an emulsion wherein tabular (plate form) grains having an aspect ratio (the ratio of the diameter in terms of a circle to thickness) of not lower than 5, preferably not lower than 8 account for at least 50% of the entire projected area of the grains.

The total coating weight of silver on the silver halide color photographic material of the present invention is preferably not more than 0.80 g/m$^2$. When the coating weight of silver is more than 0.80 g/m$^2$, fluctuation of photographic characteristics caused by continuous processing is large. A preferred coating weight is not more than 0.75 g/m$^2$. The lower limit is preferably 0.30 g/m$^2$ in view of the color forming property.

The silver chlorobromide emulsions of the present invention can be prepared according to the methods described in P. Glafkides, *Chemie et Phisique Photographique* (Paul Montel, 1967), G. F. Dunfin, *Photographic Emulsion Chemistry* (Focal Press, 1966) and V. L. Zelikman et al., *Making and Coating Photographic Emulsion* (Focal Press, 1964). An acid process, neutral process or ammonia process can be used to form the emulsions. A soluble silver salt and a soluble halogen salt can be reacted in accordance with a single jet process, double jet process or a combination thereof. A reverse mixing method in which grains are formed in the presence of excess silver ion can be used. There can be also used a controlled double jet process in which the pAg in a liquid phase, where silver halide is formed, is maintained constant. According to this process, there can be obtained silver halide emulsions wherein the crystal form is regular and grain size is approximately uniform.

Various polyvalent metal ion impurities can be introduced into the silver halide emulsions of the present invention during the course of the formation of grains or during physical ripening.

Examples of compounds which can be used for the introduction of the metal ions include salts of cadmium, zinc, lead, copper and thallium, salts of Group VIII metals such as iron, ruthenium, rhodium, palladium, osmium, iridium and platinum and complex salts thereof. Among them, Group VIII metals are preferred. The amounts of these compounds to be added widely vary according to purpose, but are preferably in the range of $1\times10^{-9}$ to $1\times10^{-2}$ mol based on the amount of silver halide.

Usually, the silver halide emulsions of the present invention are subjected to chemical sensitization.

Examples of chemical sensitization methods include sulfur sensitization using unstable sulfur compounds, noble metal sensitization such as gold sensitization and reduction sensitization. These sensitization methods may be used either alone or a combination of two or more them. preferred compounds which can be used for chemical sensitization are described in JP-A No. 62-215272 (pages 18 to 22)

Various compounds or precursors thereof can be added to the silver halide emulsions of the present invention for the purposes of preventing fogging during the preparation or storage of the photographic material or during processing or for the purpose of stabilizing photographic performance. They are generally called photographic stabilizers. Preferred examples of these compounds are described in JP-A No. 62-215272 (pages 39 to 72).

The emulsions of the present invention may be surface latent image type emulsions wherein a latent image is mainly formed on the surfaces of the grains or internal latent image type emulsions wherein a latent image is mainly formed in the interiors of the grains.

The color photographic materials generally contain yellow couplers forming yellow color, magenta couplers forming magenta color and cyan couplers forming cyan color, each of them forming a color by coupling with the oxidation products of aromatic amine developing agents.

Among the yellow couplers which can be used in the present invention, acylacetamide compounds such as benzoylacetanilide and pivaloylacetanilide are preferred. Among them, compounds having the following formulas (Y-1) and (Y-2) are preferred as the yellow couplers.

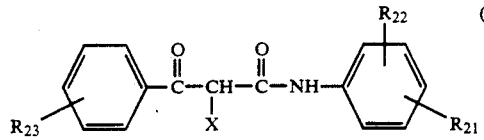

(Y-1)

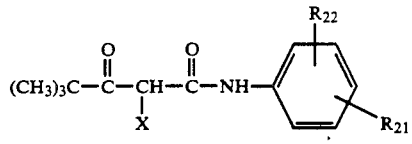

(Y-2)

In the above formulas, X is a hydrogen atom or a coupling releasing group; $R_{21}$ is a non-diffusing group having from 8 to 32 carbon atoms; $R_{22}$ is a hydrogen atom, one or more halogen atoms, a lower alkyl group, a lower alkoxy group or a non-diffusing group having from 8 to 32 carbon atoms; $R_{23}$ is a hydrogen atom or a substituent group; and when two or more $R_{23}$ groups exist, they may be the same or different groups.

Pivaloylacetanilide type yellow couplers are described in more detail in U.S. Pat. Nos. 4,622,287 (column 3 line 15 to column 8 line 39) and 4,623,616 (column 14 line 50 to column 19 line 41).

Benzoylacetanilide type yellow couplers are described in U.S. Pat. Nos. 3,408,194, 3,933,501, 4,046,575, 4,133,958 and 4,401,752.

Examples of the pivaloyacetanilide type yellow couplers include compounds (Y-1) to (Y-39) described in U.S. Pat. No. 4,622,287 (column 37 to 54). Among them, there are preferred (Y-1), (Y-4), (Y-6), (Y-7), (Y-15), (Y-21), (Y-22), (Y-23), (Y-26), (Y-35), (Y-36), (Y-37), (Y-38), and (Y-39).

Other examples thereof include compounds (Y-1) to (Y-33) described in U.S. Pat. No. 4,623,616 (column 19 to 24). Among them, there are preferred (Y-2), (Y-7), (Y-8), (Y-12), (Y-20), (Y-21), (Y-23), and (Y-29).

Other preferred examples of the yellow couplers include compound (34) described in U.S. Pat. No. 3,408,194 (column 6), compounds (16) and (19) described in U.S. Pat. No. 3,933,501 (column 8), compound (9) described in U.S. Pat. No. 4,046,575 (column 7 to 8), compound (1) described in U.S. Pat. No. 4,133,958 (column 5 to 6), compound (1) described in U.S. Pat. No. 4,401,752 (column 5) and the following compounds (a) to (h).

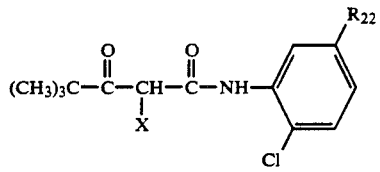

| Compound | $R_{22}$ | X |
|---|---|---|
| a | $-COOCH(CH_3)COOC_{12}H_{25}$ | 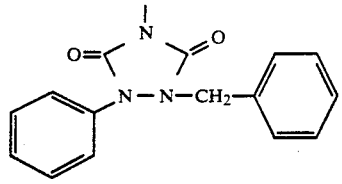 |
| b | $-COOCH(C_4H_9)COOC_{12}H_{25}$ | " |
| c | 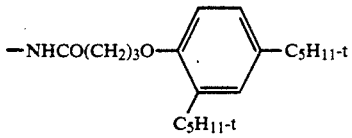 | 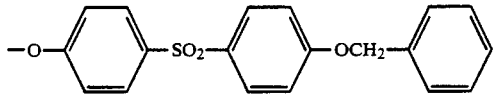 |
| d | " | 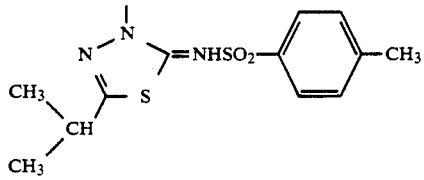 |
| e | " | 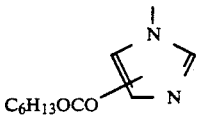 |
| f | $-NHSO_2C_{12}H_{25}$ | 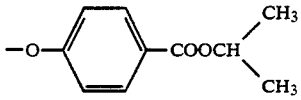 |
| g | $-NHSO_2C_{16}H_{33}$ | 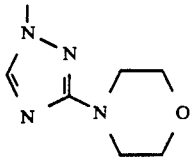 |
| h | $-NHC(=O)CH(CH_3).CH_2SO_2C_{12}H_{25}$ | 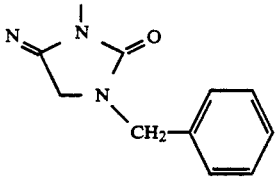 |

Among the above couplers, compounds where the releasing atom is a nitrogen atom are particularly preferred.

Other examples of magenta couplers which can be used in the present invention include oil protective type indazolone couplers, cyanoacetyl couplers, preferably 5-pyrazolone couplers and pyrazolotriazole couples such as pyrazoloazole. 5-Pyrazolone couplers having an arylamino group or an acylamino group at the 3-position are preferred from the viewpoints of hue and color density of the color forming dyes. Typical examples thereof are described in U.S. Pat. Nos. 2,311,082, 2,343,703, 2,600,788, 2,908,573, 3,062,653, 3,152,896 and 3,936,015. Nitrogen atom releasing groups described in U.S. Pat. No. 4,310,619 or arylthio groups described in U.S. Pat. No. 4,351,897 and WO(PCT) 88/04795 are preferred as the releasing groups of two equivalent type 5-pyrazolone couplers. 5-Pyrazolone couplers having ballast group described in European Patent No. 73,636 give high color density.

Examples of pyrazoloazole couplers include pyrazolobenzimidazoles described in U.S. Pat. No. 2,369,879, preferably pyrazolo[5,1-c][1,2,4]triazoles described in U.S. Pat. No. 3,725,067, pyrazolotetrazoles described in *Research Disclosure* No. 24220 (June 1984) and pyrazolopyrazoles described in *Research Disclosure* No. 24230 (June 1984). These couplers may be polymer couplers.

These compounds can be represented by the following formulas (M-1), (M-2) and (M-3).

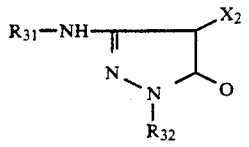

(M-1)

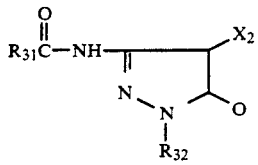

(M-2)

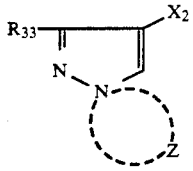

(M-3)

In the above formulas, $R_{31}$ is a non-diffusing group having from 8 to 32 carbon atoms in total; $R_{32}$ is a phenyl group or a substituted phenyl group; $R_{33}$ is a hydrogen atom or a substituent group; Z is a non-metallic atomic group required for the formation of a five-membered azole ring having 2 to 4 nitrogen atoms and the azole ring may have one or more substituent groups (including a condensed ring); and $X_2$ is a hydrogen atom or a releasing group.

The substituent group $R_{33}$ and the substituent groups for the azole ring are in more detail described in U.S. Pat. No. 4,540,654 (second column, line 41 to 8th column, line 27).

Among the pyrazoloazole couplers, imidazo[1,2-b]-pyrazoles described in U.S. Pat. No. 4,500,630 are preferred from the viewpoints of fastness to light and low degree of secondary yellow absorption. Pyrazolo[1,5-b][1,2,4]-triazoles described in U.S. Pat. No. 4,540,654 are particularly preferred.

Other preferred examples of pyrazoloazole couplers include pyrazolotriazole couplers where a branched alkyl group is attached directly to the 2,3 or 6-position of the pyrazolotriazole ring described in JP-A No. 61-65245; pyrazoloazole couplers having a sulfonamide group described in JP-A No. 61-65246, pyrazoloazole couplers having alkoxysulfonamide ballast group described in JP-A No. 61-47254 and pyrazolotriazole couplers having an alkoxy group or an aryloxy group at the 6-position described in European Patent (Laid-Open) No. 226,894.

Typical examples of these couplers include the following compounds.

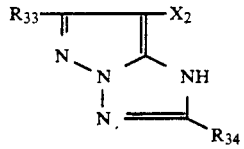

| Compound | $R_{33}$ | $R_{34}$ | $X_2$ |
|---|---|---|---|
| M'-1 | $CH_3$— | 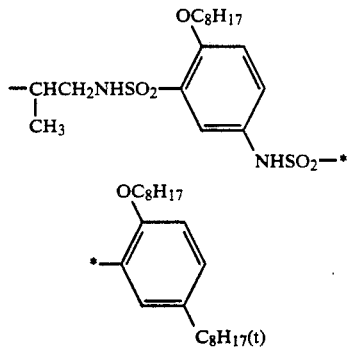 | Cl |
| M'-2 | " | 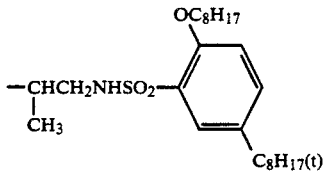 | " |
| M'-3 | " | 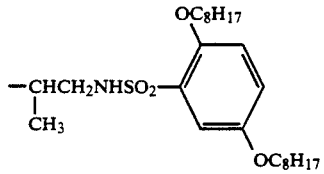 | 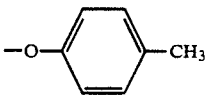 |

-continued
| | | | |
|---|---|---|---|
| M'-4 | 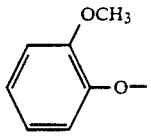 | 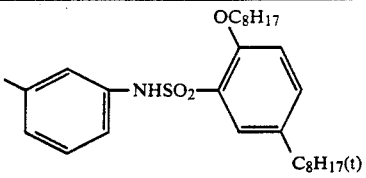 | 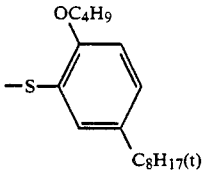 |
| M'-5 | $CH_3$— | 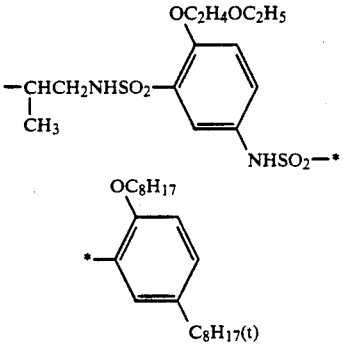 | Cl |
| M'-6 | " | 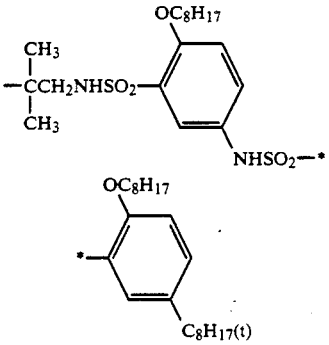 | " |
| M'-7 | 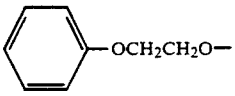 | 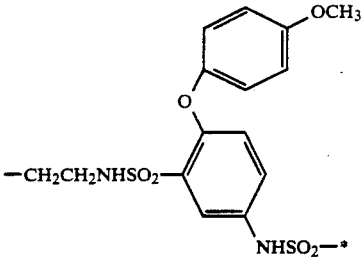 | 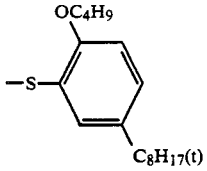 |
| M'-7 | | 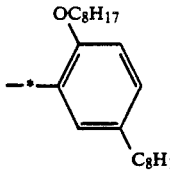 | |
| M'-8 | $CH_2CH_2O$— | Same as M'-7 | Same as M'-7 |
| M'-9 | 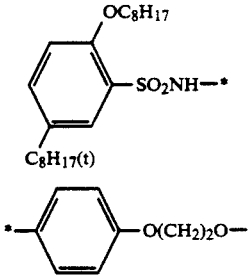 | 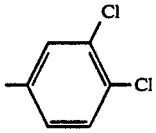 | " |

-continued

| | | | |
|---|---|---|---|
| M'-10 | $CH_3$— | $OC_2H_4OC_6H_{13}$<br>—CH($CH_3$)$CH_2NHSO_2$—<br>$C_8H_{17}$(t) | Cl |

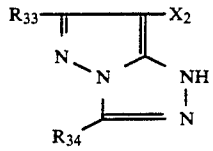

| Compound | $R_{33}$ | $R_{34}$ | $X_2$ |
|---|---|---|---|
| M'-11 | $CH_3$— | HO—$C_6H_4$—$SO_2$—$C_6H_4$—OCH($C_{10}H_{21}$)CONH—*<br>*—$C_6H_4$—$(CH_2)_3$ | Cl |
| M'-12 | " | (n)$C_6H_{13}$<br>CH$CH_2SO_2(CH_2)_2$<br>(n)$C_6H_{17}$ | " |
| M'-13 | $CH_3$<br>CH—<br>$CH_3$ | $OC_4H_9$<br>—$SO_2(CH_2)_3$<br>$C_8H_{17}$(t) | " |
| M'-14 | —(CH—$CH_2$)$_{50}$—*<br>$COOCH_2CH_2OCH_3$<br>$CH_3$<br>*—($CH_2$—C)$_{50}$—<br>CONH— | $CH_3$—CH—<br>$CH_2NHSO_2CH_3$ | " |
| M'-15 | —O— | $OC_8H_{17}$<br>$(CH_2)_2NHSO_2$—<br>$C_8H_{17}$(t) | Cl |
| M'-16 | Cl<br>—O— | $OC_8H_{17}$<br>$(CH_2)_2NHSO_2$—<br>$C_8H_{17}$(t) | $OC_4H_9$<br>—S—<br>$C_8H_{17}$(t) |

-continued
(M'-17)
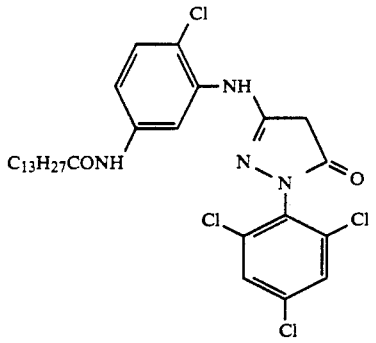
(M'-18)
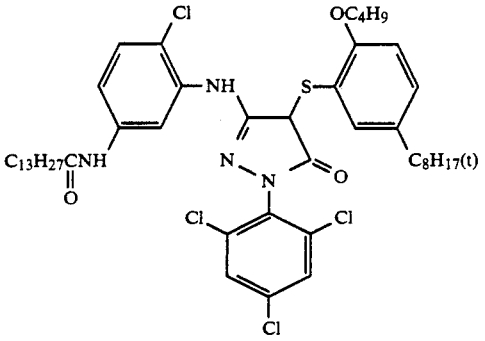
(M'-19)
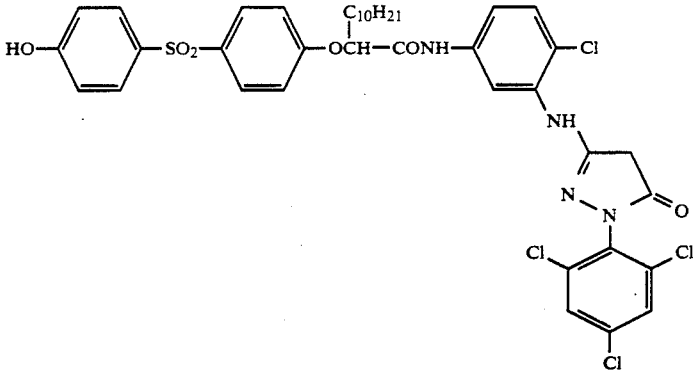
(M'-20)
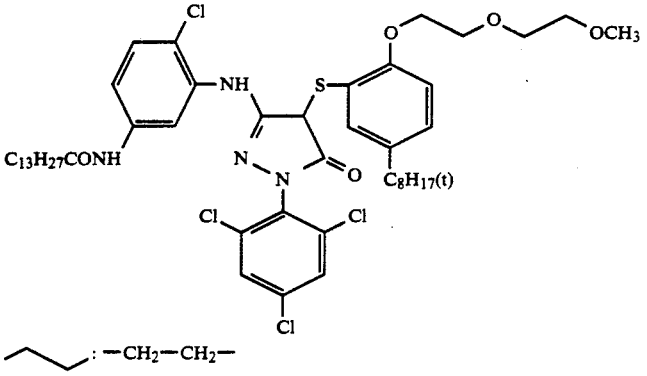

-continued
(M'-21)
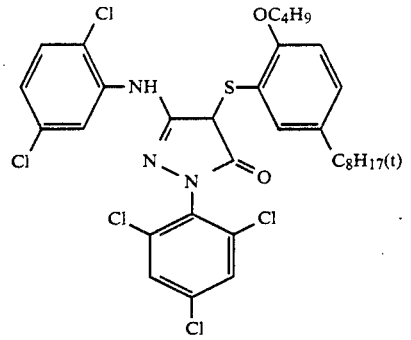
(M'-22)
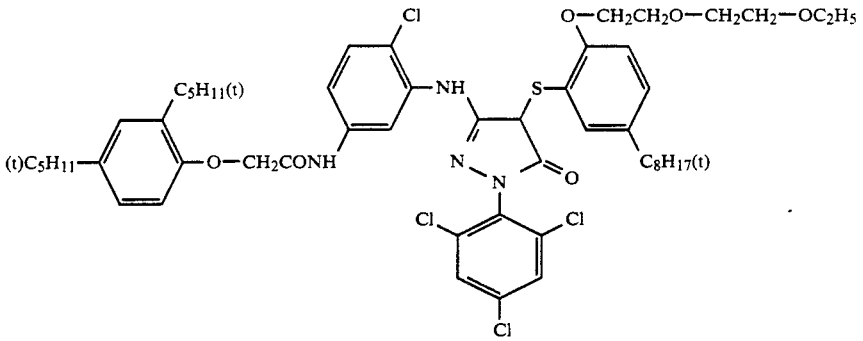
(M'-23)
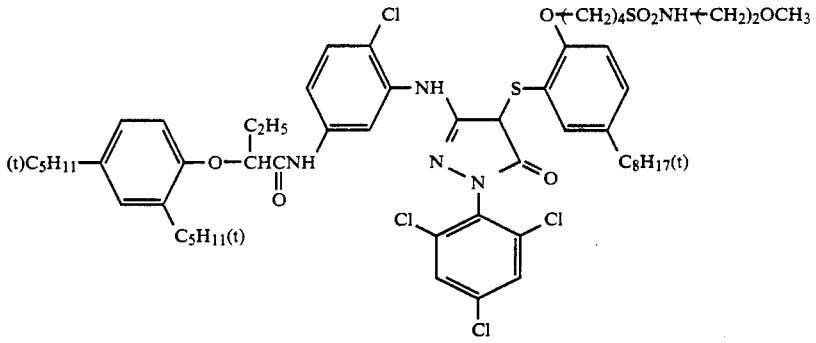
(M'-24)
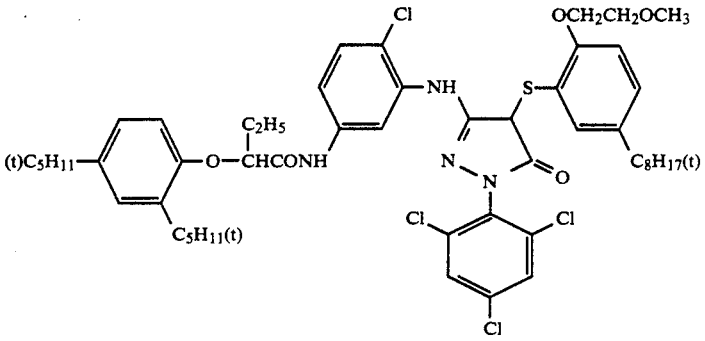

-continued
(M'-25)
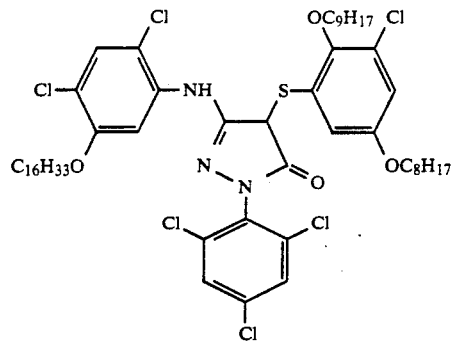
(M'-26)
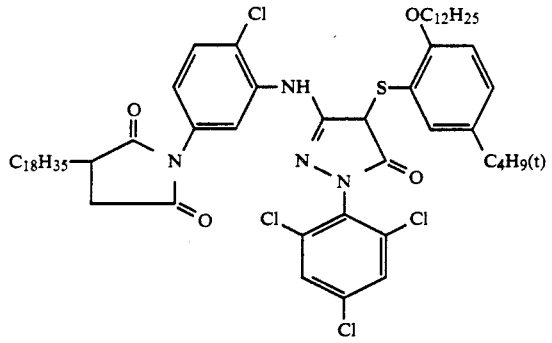
(M'-27)
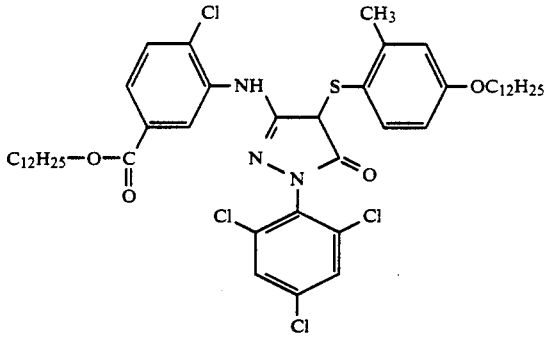
(M'-28)
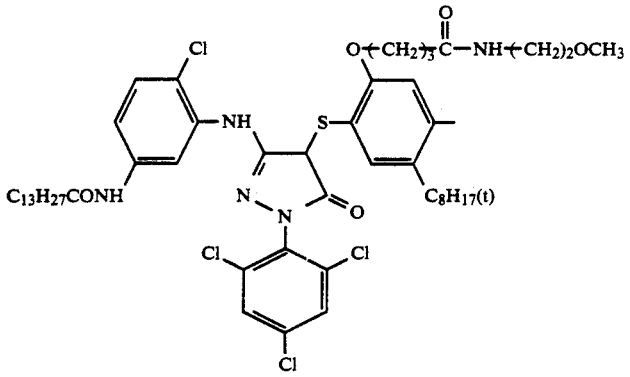

-continued
(M'-29)
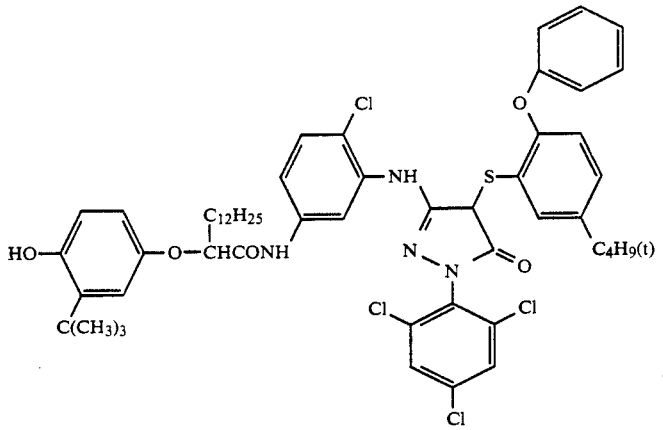
(M'-30)
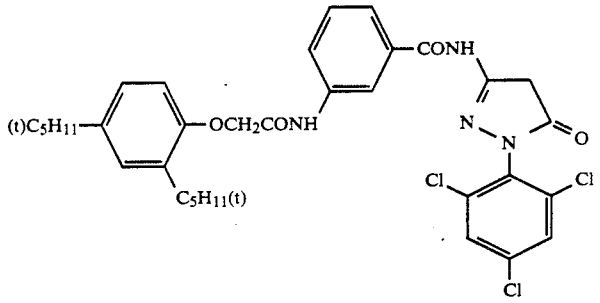
(M'-31)
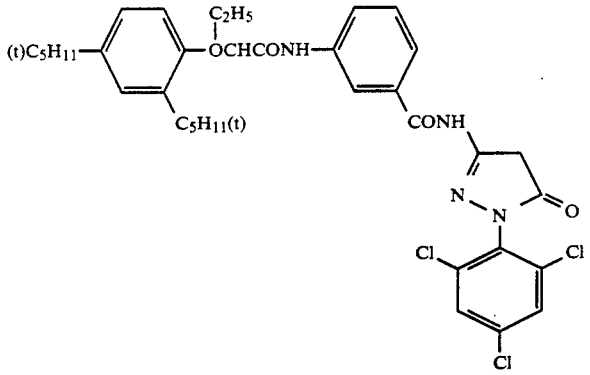
(M'-32)
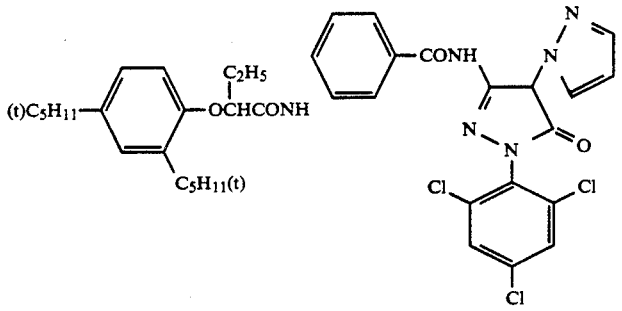

-continued

M'-33

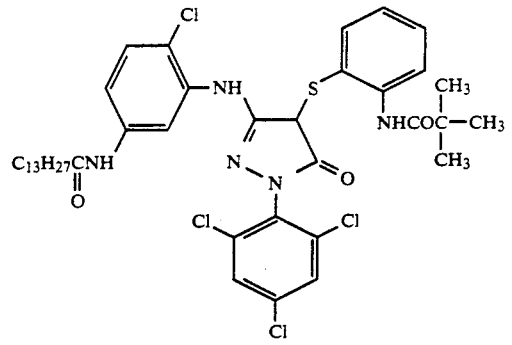

M'-34

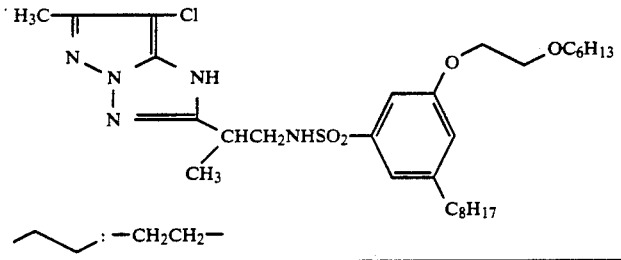

Most typical examples of cyan couplers are phenol cyan couplers and naphthol cyan couplers.

Examples of cyan couplers include compounds having an acylamino group at the 2-position of the phenol nucleus and an alkyl group at the 5-position of the phenol nucleus (including polymer couplers) described in U.S. Pat. Nos. 2,369,929, 4,518,687, 4,511,647 and 3,772,002. Typical examples thereof include the coupler described in Example 2 of Canadian Patent 625,822, compound (1) described in U.S. Pat. No. 3,772,002, compounds (I-4) and (I-5) described in U.S. Pat. No. 4,564,590, compounds (1), (2), (3) and (24) described in JP-A No. 61-39045 and compound (C-2) described in JP-A No. 62-70846.

Other examples of phenol cyan couplers include 3,3-diacylaminophenol couplers described in U.S. Pat. Nos. 2,772,162, 2,895,826, 4,334,011 and 4,500,653 and JP-A No. 59-164555. Typical examples thereof include compound (V) described in U.S. Pat. No. 2,895,826, compound (17) described in U.S. Pat. No. 4,557,999, compounds (2) and (12) described in U.S. Pat. No. 4,565,777, compound (4) described in U.S. Pat. No. 4,124,396 and compound (I-19) described in U.S Pat. No. 4,613,564.

Other examples of phenol cyan couplers include compounds where a nitrogen-containing heterocyclic ring is condensed with a phenol nucleus described in U.S. Pat. Nos. 4,372,173, 4,564,586 and 4,430,423, JP-A Nos. 61-390441 and 62-257158. Typical examples thereof include couplers (1) and (3) described in U.S. Pat. No. 4,327,173, compounds (3) and (16) described in U.S. Pat. No. 4,564,586, compounds (1) and (3) described in U.S. Pat. No. 4,430,423 and the following compounds.

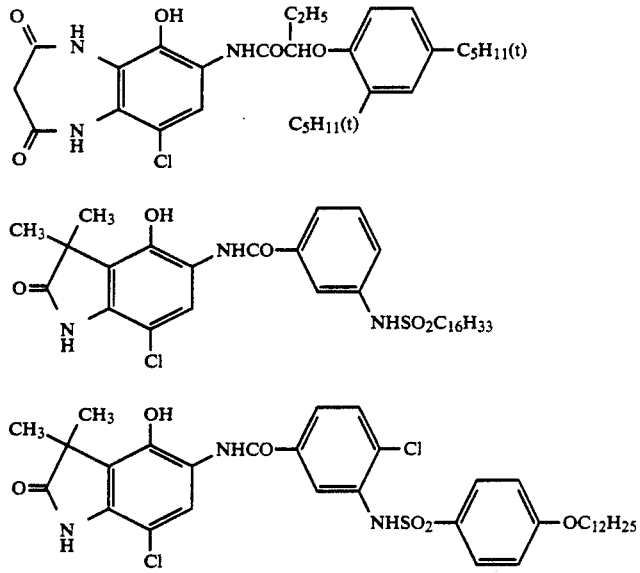

-continued
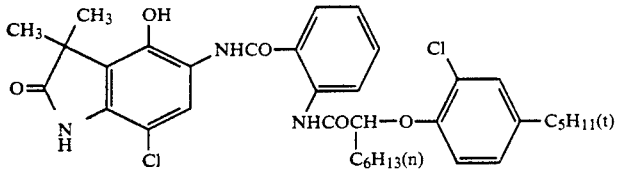
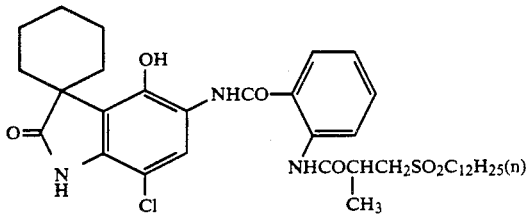
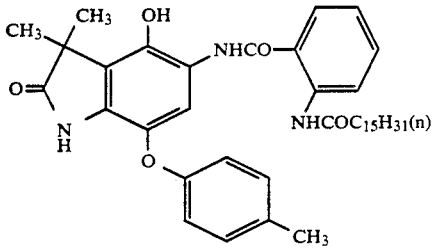
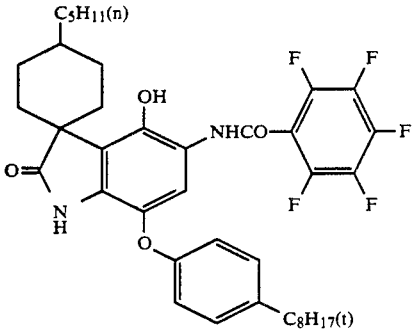
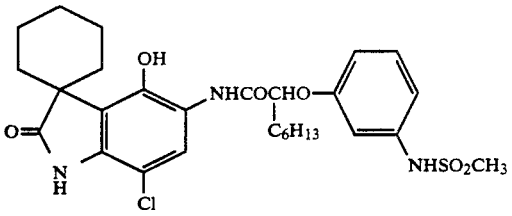
In addition to the above cyan couplers, the following diphenylimidazole cyan couplers described in European Patent (Laid-Open) No. 240,453A2 can be used.
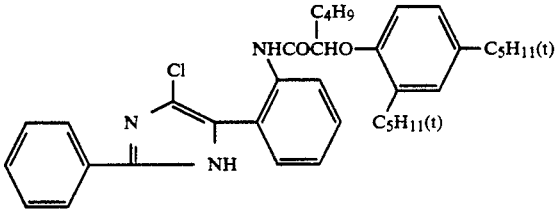

-continued

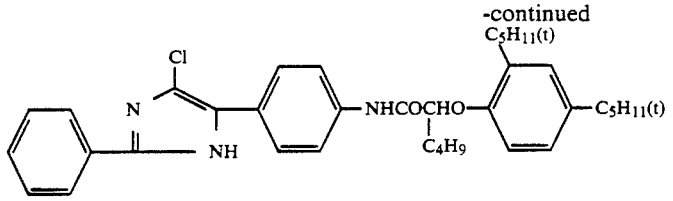

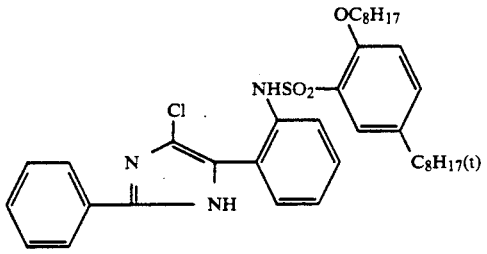

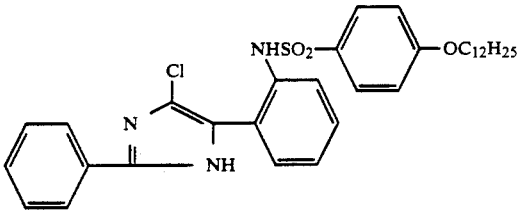

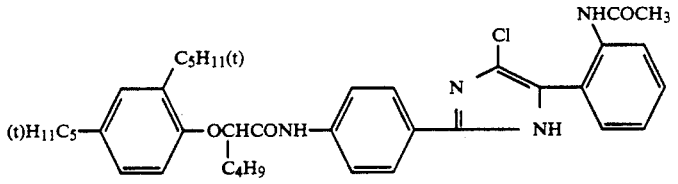

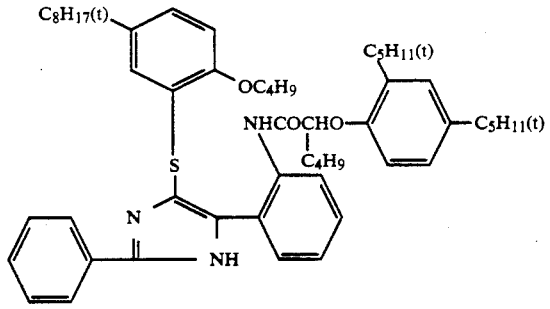

Other examples of phenol cyan couplers include ureido couplers described in U.S. Pat. Nos. 4,333,999, 4,451,559, 4,444,872, 4,427,767 and 4,579,813 and European Patent No. 067,689B1. Typical examples thereof include coupler (7) described in U.S. Pat. No. 4,333,999, coupler (1) described in U.S. Pat. No. 4,451,559, coupler (14) described in U.S. Pat. No. 4,444,872, coupler (3) described in U.S. Pat. No. 4,427,767, couplers (6) and (24) described in U.S. Pat. No. 4,609,619, couplers (1) and (11) described in U.S. Pat. No. 4,579,813, couplers (45) and (50) described in European Patent No. 067,689B1 and coupler (3) described in JP-A No. 61-42658.

Examples of the naphthol cyan couplers include compounds having an N-alkyl-N-arylcarbamoyl group at the 2-position of the naphthol nucleus (e.g., described in U.S. Pat. No. 2,313,586), compounds having an alkylcarbamoyl group at the 2-position (e.g., described in U.S. Pat. Nos. 2,474,293 and 4,282,312), compounds having an arylcarbamoyl group at the 2-position (e.g., described in JP-B No. 50-14523), compounds having a carbonamido group or a sulfonamide group at the 5-position (e.g., described in JP-A Nos. 60-237448, 61-145557, 153640), compounds having an aryloxy releasing group (e.g., described in U.S. Pat. No. 3,476,563), compounds having a substituted alkoxy releasing group (e.g., described in U.S. Pat. No. 4,296,199) and compounds having a glycolic acid releasing group (e.g., described in JP-B No. 39217).

These couplers can be allowed to coexist with at least one high-boiling organic solvent and the couplers can be dispersed and incorporated in emulsion layers. Preferably, high-boiling organic solvents represented by the following formulas (A) to (E) are used.

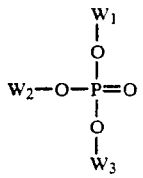

(A)

$W_1—COO—W_2$ (B)

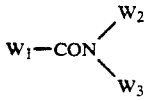

(C)

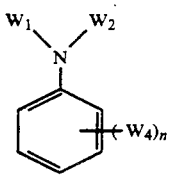

(D)

$W_1—O—W_2$ (E)

In the above formulas (A) to (E) $W_1$, $W_2$ and $W_3$ are each a substituted or unsubstituted alkyl, cycloalkyl, alkenyl, aryl or heterocyclic group; $W_4$ is $W_1$, $OW_1$ Or $SW_1$; and n is an integer of from 1 to 5. When n is 2 or greater, $W_4$ may be the same or different groups. In formula (E), $W_1$ and $W_2$ may be combined together to form a condensed ring.

The couplers are impregnated with latex polymer (e.g., described in U.S. Pat. No. 4,203,716) in the presence or absence of the high-boiling organic solvent, or dissolved in a water-insoluble and organic solvent-soluble polymer and can be emulsified in an aqueous solution of hydrophilic colloid. Preferably, homopolymers or copolymers described in WO No. 88/00723 (pages 12 to 30) are used. Particularly, acrylamide polymers are preferred from the viewpoint of dye image stability.

The photographic materials prepared by the present invention may contain hydroquinone derivatives, aminophenol derivatives, gallic acid derivatives and ascorbic acid derivatives as color fogging inhibitors (antifogging agents).

The photographic materials of the present invention may contain various anti-fading agents. Examples of the anti-fading agents for cyan, magenta and/or yellow images include hydroquinones, 6-hydroxychromans, 5-hydroxycoumarans, spiro-chromans, hindered phenols such as bisphenols and p-alkoxyphenols, gallic acid derivatives, methylenedioxybenzenes, aminophenols, hindered amines and ethers or ester derivatives obtained by silylating or alkylating a phenolic hydroxyl group of the above-described compounds. Further, metal complexes such as (bissalicyl-aldoximato)nickel complex and (bis-N,N-dialkyldithiocarbamato)nickel can also be used.

Examples of organic anti-fading agents include hydroquinones described in U.S. Pat. Nos. 2,360,290, 2,418,613, 2,700,453, 2,701,197, 2,728,659, 2,732,300, 2,7354,765, 3,982,944 and 4,430,425, British Patent No. 1,363,921, U.S. Pat. Nos. 2,710,801 and 2,816,018; 6-hydroxychromans, 5-hydroxycoumarans and spirochromans described in U.S. Pat. Nos. 3,432,300, 3,573,050, 3,574,627, 3,698,909 and 3,764,337 and JP-A No. 52-152225; spiro-indanes described in U.S. Pat. No. 4,360,589; p-alkoxyphenols described in U.S. Pat. No. 2,735,765, British Patent No. 2,066,975, JP-A No. 59-10539 and JP-B No. 57-19765; hindered phenols described in U.S. Pat. Nos. 3,700,455 and 4,228,235, JP-A No. 52-72224 and JP-B No. 52-6623; gallic acid derivatives, methylenedioxybenzenes and aminophenols described in U.S. Pat. Nos. 3,457,079 and 4,332,886 and JP-B No. 56-21144; hindered amines described in U.S. Pat. Nos. 3,336,135 and 4,268,593, British Patent Nos. 1,326,889, 1,354,313 and 1,410,846, JP-B No. 51-1420, JP-A Nos. 58-114036, 59-53846 and 59-78344; ether and ester derivatives of phenolic hydroxyl group described in U.S. Pat. Nos. 4,155,765, 4,174,220, 4,254,216 and 4,264,720, JP-A Nos. 54-145530, 55-6321, 58-105147, 59-10539, 57-37856, U.S. Pat. No. 4,279,990 and JP-B No. 53-3263; and metal complexes described in U.S. Pat. Nos. 4,050,938 and 4,241,155 and British Patent No. 2,027,731 (A). These compounds are used in an amount of generally 5 to 100% by weight based on the amount of the corresponding coupler. These compounds can be co-emulsified with the couplers and added to the emulsion layers. It is preferred that an ultraviolet light absorbing agent is introduced into both layers adjacent to the cyan color forming layer to prevent the cyan color image from being deteriorated by heat and particularly light.

Among the anti-fading agents, spiro-indanes and hindered amines are particularly preferred.

It is preferred that the following compounds are used together with the above-described couplers, particularly the pyrazoloazole couplers in the present invention.

Namely, compounds (F) and/or compounds (G) alone or in combination are used, the compounds (F) being chemically bonded to aromatic amine developing agents left behind after color development to form a compound which is chemically inactive and substantially colorless, and the compounds (G) being chemically bonded to the oxidants of the aromatic amine developing agents left behind after color development to form a compound which is chemically inactive and substantially colorless. When the compounds (F) and/or the compounds (G) are used, the formation of stain due to the formation of color dye by the reaction of the couplers with the color developing agents or their oxidants left in the layer during storage after processing or other side effects can be prevented.

As compounds (F), there are preferred compounds having a second-order reaction constant $K_2$ (in terms of the reaction with p-anisidine in trioctyl phosphate at 80° C.) of from 1.0 l/mol·sec to $1\times10^{-5}$ l/mol·sec.

When $K_2$ exceeds the range described above, the compounds themselves become unstable and often react with gelatin or water and decompose, while when $K_2$ is smaller than the range described above, the reaction thereof with the aromatic amine developing agents left behind are retarded and as a result, the side effects of the aromatic amine developing agents left behind after development can not be prevented.

Preferred examples of compounds (F) include the following compound represented by the following formula (FI) or (FII).

$(R1)—(A)_n—X$ (FI)

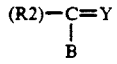

(FII)

In the above formulas (FI) and (FII), (R1) and (R2) are each an aliphatic group, an aromatic group or a heterocyclic group; n is 1 or 0; B is a hydrogen atom, an aliphatic group, an aromatic group, a heterocyclic group, an acyl group or a sulfonyl group; Y is a group which accelerates the addition of the aromatic amine developing agents to the compounds having the formula (FII); and (R1) and X or Y and (R2) or B may be combined together to form a ring structure.

Typical reactions for chemically bonding the aromatic amine developing agents left behind are substitution reaction and addition reaction.

Examples of compounds having the formulas (FI) and (FII) are described in JP-A Nos. 64-2042, 64-86139, 1-55558, 1-57259, 1-1198751and 1-120554.

Combinations of compounds having formula (G) with compounds having formula (F) are described in Japanese Patent Application No. 63-18439.

The hydrophilic colloid layers of the photographic materials of the present invention may contain ultraviolet light absorbing agents. Examples of ultraviolet light absorbing agents include aryl group-substituted benzotriazole compounds described in U.S. Pat. No. 3,533,794; 4-thiazolidone compounds described in U.S. Pat. Nos. 3,314,794 and 3,352,681; benzophenone compounds described in JP-A No. 46-2784; cinnamic ester compounds described in U.S. Pat. Nos. 3,705,805 and 3,707,375; butadiene compounds described in U.S. Pat. No. 4,045,229; and benzoxydol compounds described in U.S. Pat. No. 3,700,455. If desired, ultraviolet absorbing couplers (e.g., α-naphthol cyan color forming couplers) and ultraviolet light absorbing polymers may be used. These ultraviolet light absorbers may be incorporated in specific layers.

The hydrophilic colloid layers of the photographic materials may contain water-soluble dyes as filter dyes or for the purpose of preventing irradiation. Examples of such dyes include oxonol dyes, hemioxonol dyes, styryl dyes, merocyanine dyes, cyanine dyes and azo dyes. Among them, oxonol dyes, hemioxonol dyes and merocyanine dyes are preferred.

Gelatin is preferred as a binder or protective colloid for the emulsion layers of the photographic materials of the present invention. In addition thereto, a hydrophilic colloid alone or in combination with gelatin can be used.

A lime-processed gelatin or an acid-processed gelatin can be used. The preparation of gelatin is described in more detail in Arthur, Weiss, *The Macromelecular Chemistry of Gelatin* (Academic Press 1964).

As supports for use in the present invention, transparent films such as a cellulose nitrate film or polyethylene terephthalate film, or a reflection type support can be used. For the purpose of the present invention, the reflection type support is preferable.

The term "reflection type support" as used herein refers to supports which enhance reflection properties to make a dye image formed on the silver halide emulsion layer clear. Examples of the reflection type support include supports coated with a hydrophobic resin containing a light reflecting material such as titanium oxide, zinc oxide, calcium carbonate or calcium sulfate dispersed therein and supports composed of a hydrophobic resin containing a light reflecting material dispersed therein. Typical examples of the supports include baryta paper, polyethylene coated paper, polypropylene synthetic paper, transparent supports coated with a reflecting layer or containing a reflection material, glass sheet, polyester film such as polyethylene terephthalate film and cellulose triacetate or nitrocellulose, polyamide films, polycarbonate films, polystyrene films and vinyl chloride resins. These supports can be properly chosen according to the purpose of use.

It is preferred that as the reflecting material, a white pigment is thoroughly kneaded in the presence of a surfactant or the surfaces of pigment particles are treated with a dihydric to tetrahydric alcohol.

The occupied area ratio (%) of fine particles of white pigment per unit area can be determined by dividing the observed area into adjoining unit areas of 6 μm×6 μm and measuring the occupied area ratio (%) (Ri) of the fine particles projected on the unit area. A coefficient of variation of the occupied area ratio (%) can be determined from the ratio ($S/\overline{R}$) of standard deviation S of Ri to the mean value ($\overline{R}$) of Ri. The number (n) of divided unit areas is preferably not smaller than 6. Accordingly, the coefficient of variation $S/\overline{R}$ can be determined by the following formula.

$$\sqrt{\frac{\sum_{n=1}^{n}(R_i-\overline{R})^2}{n-1}} \Big/ \frac{\sum_{i=1}^{n} R_i}{n}$$

In the present invention, the coefficient of variation of the occupied are ratio (%) of the fine pigment particles is preferably not higher than 0.15, particularly not higher than 0.12. When the value is not higher than 0.08, it is considered that the dispersion of the particles is substantially uniform.

The present invention is now illustrated in greater detail by reference to the following examples which, however, are not to be construed as limiting the invention in any way.

EXAMPLE 1

A paper support (both sides thereof being laminated with polyethylene) was coated with the following solutions to prepare a multi-layer color photographic paper having the following layer structure. Coating solutions were prepared in the following manner.

Preparation of coating solution for first layer 60.0 g of yellow coupler (E×Y) and 28.0 g of antifading agent (Cpd-1) were dissolved in 150 ml of ethyl acetate, 1.0 ml of solvent (Solv-3) and 3.0 ml of solvent (Solv-4). The resulting solution was added to 450 ml of a 10 wt% aqueous gelatin solution containing sodium dodecylbenzenesulfonate and the mixture was dispersed by using an ultrasonic homogenizer. The resulting dispersion was mixed with 420 g of a silver chlorobromide (silver bromide content: 0.7 mol%) containing the following blue-sensitive sensitizing dye and the mixture was dissolved to prepare a coating solution for first layer.

Coating solutions for the second to seventh layers were prepared in the same manner as in the preparation of the coating solution for the first layer. There was used 1,2-bis(vinylsulfonyl)ethane as the hardening agent for gelatin in each layer.

The following spectral sensitizing dyes for the following layers were used.

Blue-sensitive emulsion layer:

Anhydro-5,5'chloro-3,3'-disulfoethylthiacyanine hydroxide

Green-sensitive emulsion layer:

Anhydro-9-ethyl-5,5'-diphenyl-3,3'-disulfoethyloxacarbocyanine hydroxide

Red-sensitive emulsion layer:

S-6

($9\times10^{-4}$ mol per mol of silver halide)

The following stabilizers were used for each emulsion layer.

A 7/2/1 (by molar ratio) mixture of the following A, B and C.

A: 1-(2-acetamino-phenyl)-5-mercaptotetrazole

B: 1-phenyl-5-mercaptotetrazole

C: 1-(p-methoxyphenyl)-5-mercaptotetrazole

The following compounds were used as irradiation-preventing dyes.

[3-Carboxy-5-hydroxy-4-(3-(3-carboxy-5-oxo-1-(2,5-disulfonatophenyl)-2-pyrazoline-4-ylidene)-1-propenyl)-1-pyrazolyl]-benzene-2,5-disulfonate disodium salt.

N,N'-(4,8-Dihydroxy-9,10-dioxo-3,7-disulfonatoanthracene-1,5-diyl)bis-(aminomethanesulfonate)-tetrasodium salt.

[3-Cyano-5-hydroxy-4-(3-(3-cyano-5-oxo-1-(4-sulfonatophenyl)-2-pyrazoline-4-ylidene)-1-pentanyl)-1-pyrazolyl]benzene-4-sulfonate sodium salt.

Layer Structure

Each layer had the following composition. Numerals represent coating weight (g/m$^2$). The amounts of the silver halide emulsions are represented by coating weight in terms of silver.

Support

Paper support (both sides thereof being laminated with polyethylene).

| | Coating weight |
|---|---|
| First layer (blue-sensitive layer) | |
| Silver chlorobromide emulsion (AgBr content: 0.7 mol %, cube, mean grain size: 0.9 μm) | 0.27 |
| Gelatin | 1.80 |
| Yellow coupler (ExY) | 0.60 |
| Anti-fading agent (Cpd-1) | 0.28 |
| Solvent (Solv-3) | 0.01 |
| Solvent (Solv-4) | 0.03 |
| Second layer (color mixing inhibiting layer) | |
| Gelatin | 0.80 |
| Color mixing inhibitor (Cpd-2) | 0.055 |
| Solvent (Solv-1) | 0.03 |
| Solvent (Solv-2) | 0.015 |
| Third layer (green-sensitive layer) | |
| Silver chlorobromide emulsion (AgBr content: 0.7 mol %, cube, grain size: 0.45 μm) | 0.28 |
| Gelatin | 1.40 |
| Magenta coupler (ExM) | 0.67 |
| Anti-fading agent (Cpd-3) | 0.23 |
| Anti-fading agent (Cpd-4) | 0.11 |
| Solvent (Solv-1) | 0.20 |
| Solvent (Solv-2) | 0.02 |
| Fourth layer (color mixing inhibiting layer) | |
| Gelatin | 1.70 |
| Color mixing inhibitor (Cpd-2) | 0.065 |
| Ultraviolet light absorber (UV-1) | 0.45 |
| Ultraviolet light absorber (UV-2) | 0.23 |

-continued

| | Coating weight |
|---|---|
| Solvent (Solv-1) | 0.05 |
| Solvent (Solv-2) | 0.05 |
| Fifth layer (red-sensitive layer) | |
| Silver chlorobromide emulsion (AgBr content: 2 mol %, cube, grain size: 0.5 μm) | 0.19 |
| Gelatin | 1.80 |
| Cyan coupler (ExC-1) | 0.26 |
| Cyan coupler (ExC-2) | 0.12 |
| Anti-fading agent (Cpd-1) | 0.20 |
| Color forming accelerator | 0.05 |
| Solvent (Solv-1) | 0.16 |
| Solvent (Solv-2) | 0.09 |
| Sixth layer (ultraviolet light absorbing layer) | |
| Gelatin | 0.70 |
| Ultraviolet light absorber (UV-1) | 0.26 |
| Ultraviolet light absorber (UV-2) | 0.07 |
| Solvent (Solv-1) | 0.30 |
| Solvent (Solv-2) | 0.09 |
| Seventh layer (protective layer) | |
| Gelatin | 1.07 |

(ExY) Yellow coupler

α-Pivaloyl-α-(3-benzyl-1-hydantoinyl)-2-chloro-5(β-dodecylsulfonyl)butylamido)acetanilide (ExM) Magenta 1-(2,4,6-Trichlorophenyl)-3-[2-chloro-5-(3-octadecenylsuccinimido)-anilino]-5-pyrazolone (ExC-1) Cyan coupler 2-Pentafluorobenzamido-4-chloro-5-[2-(2,4-di-tert-tamylphenoxy)-3-methylbutylamido]phenol (ExC-2) Cyan coupler 2,4-Dichloro-3-methyl-6-[α(2,4-di-tert-amylphenoxy)-butylamido]phenol (Cpd-1) Anti-fading agent 2,5-Di-tert-amylphenyl-3,5-di-tert-butylhydroxybenzoate (Cpd-2) Color mixing inhibitor 2,5-Di-tert-octylhydroquinone (Cpd-3) Anti-fading agent 1,4-Di-tert-amyl-2,5-dioctyloxybenzene (Cpd-4) Anti-fading agent 2,2'-Methylenebis(4-methyl-6-tert-butylphenol)

(Cpd-5) Color forming accelerator p-(p-toluenesulfonamido)-phenyl-dodecane (Solv-3) Solvent Di-(i-nonyl) phthalate (Solv-4) Solvent N,N-Diethylcarbonamidomethoxy-2,4-di-t-amylbenzene (UV-1) Ultraviolet light absorber 2-(2-Hydroxy-3,5-di-tert-amylphenyl)benzotriazole (UV-2) Ultraviolet light absorber 2-(2-Hydroxy-3,5-di-tert-butylphenyl)benzotriazole (Solv-1) Solvent Di(2-ethylhexyl) phthalate (Solv 2) Solvent Dibutyl phthalate In this way, a Sample A was prepared. Samples B to G were prepared in the same way as in the preparation of Sample A, except that the halogen compositions of the emulsions and the sensitizing dye of the red-sensitive emulsion layer were changed to those given in Table 1.

TABLE 1

| Sample | Halogen Composition of emulsion (Cl mol %) Blue-sensitive layer | Green-sensitive layer | Red-sensitive layer | Sensitizing dye of red-sensitive layer |
|---|---|---|---|---|
| A | 99.3 | 99.3 | 98 | S-6 |
| B | 95 | 95 | 95 | S-6 |
| C | 80 | 80 | 80 | S-6 |
| D | 70 | 70 | 70 | S-6 |
| E | 99.3 | 99.3 | 98 | S-19 |
| F | 99.3 | 99.3 | 98 | S-22 |
| G | 99.3 | 99.3 | 98 | Sen-1 |

(Sen-1) Comparative red-sensitive sensitizing dye

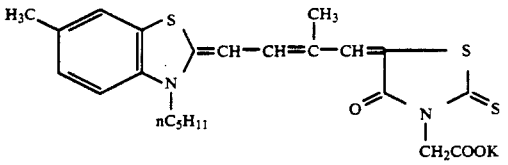

The following experiment was carried out to examine the photographic characteristics of the coated samples.

The coated samples were subjected to gradation exposure for sensitometry by using a sensitometer (FWH type, color temperature of light source: 3200° K., manufactured by Fuji Photo Film Co., Ltd.). Exposure time was 1/10 sec and exposure was conducted so as to give an exposure amount of 250 CMS.

The coated samples were processed with the following processing compositions in the following processing stages by using an automatic processor. The composition of the color developing solution was changed as shown in Table 2.

| Processing stage | Temperature | Time |
|---|---|---|
| Color development | 38° C. | 45 sec |
| Bleaching-fixing | 30~36° C. | 45 sec |
| Rinse ① | 30~37° C. | 30 sec |
| Rinse ② | 30~37° C. | 30 sec |
| Rinse ③ | 30~37° C. | 30 sec |

-continued

| Processing stage | Temperature | Time |
|---|---|---|
| Drying | 70~80° C. | 60 sec |

The rinse was carried out by three tank countercurrent system of rinse ③ → ①

Each processing solution had the following composition.

| | |
|---|---|
| Color developing solution | |
| Water | 800 ml |
| Ethylenediamine-N,N,N-tetra-methylenephosphonic acid | 3.0 g |
| Organic preservative (I-1) | 0.03 mol |
| Sodium chloride | see, Table 2 |
| Potassium bromide | see, Table 2 |
| Potassium carbonate | 25 g |
| N-Ethyl-N-(β-methanesulfonamido-ethyl)-3-Methyl-4-aminoaniline sulfate | 5.0 g |
| Triethanolamine | 10.0 g |
| Fluorescent brightener (4,4'-diamino-Stilbene type) | 2.0 g |
| Sodium sulfite | 0.01 g |
| Water to make | 1,000 ml |
| pH (25° C.) | 10.05 |
| Bleach-fixing solution | |
| Water | 400 ml |
| Ammonium thiosulfate (70 wt %) | 100 ml |
| Sodium sulfite | 17 g |
| Ethylenediaminetetraacetic acid | 55 g |
| Iron (III) ammonium | 55 g |
| Disodium ethylenediaminetetraacetate | 5 g |
| Ammonium bromide | 40 g |
| Glacial acetic acid | 9 g |
| Water to make | 1,000 ml |
| pH (25° C.) | 5.40 |

Rinsing Solution

Ion-exchanged water (the concentration of calcium and magnesium each was 3 ppm or lower).

Maximum density (Dmax) and Minimum density (Dmin) of cyan of the above processed samples were measured. The results are shown in Table 2.

Further, the above color developing solution was left to stand at an open area value (the area of opening/the capacity of solution) of 0.02 $cm^{-1}$ and at room temperature for two weeks. Subsequently, the evaluation of sensitometry was carried out. An increase ΔD min in minimum density of cyan with the passage of time was measured. The results are shown in Table 2.

TABLE 2

| Experiment | Sample | Chlorine ion concn. in developing solution (mol/l) | Bromine ion conc. in developing solution (mol/l) | Dmax | Dmin | Δ Dmin | Remarks |
|---|---|---|---|---|---|---|---|
| 1 | A | $6 \times 10^{-2}$ | $2 \times 10^{-4}$ | 2.82 | 0.10 | 0 | Invention |
| 2 | B | $6 \times 10^{-2}$ | $2 \times 10^{-4}$ | 2.80 | 0.10 | 0 | Invention |
| 3 | C | $6 \times 10^{-2}$ | $2 \times 10^{-4}$ | 2.75 | 0.10 | 0.01 | Invention |
| 4 | D | $6 \times 10^{-2}$ | $2 \times 10^{-4}$ | 2.37 | 0.12 | 0.03 | Comp. Ex. |
| 5 | E | $6 \times 10^{-2}$ | $2 \times 10^{-4}$ | 2.83 | 0.10 | 0 | Invention |
| 6 | F | $6 \times 10^{-2}$ | $2 \times 10^{-4}$ | 2.85 | 0.10 | 0 | Invention |
| 7 | G | $6 \times 10^{-2}$ | $2 \times 10^{-4}$ | 2.82 | 0.11 | 0.03 | Comp. Ex. |
| 8 | A | $6 \times 10^{-2}$ | 0 | 2.83 | 0.12 | 0.04 | Comp. Ex. |
| 9 | A | $6 \times 10^{-2}$ | $2 \times 10^{-3}$ | 2.52 | 0.10 | 0 | Comp. Ex. |
| 10 | A | $5 \times 10^{-3}$ | $2 \times 10^{-4}$ | 2.82 | 0.11 | 0.03 | Comp. Ex. |
| 11 | A | $2 \times 10^{-1}$ | $2 \times 10^{-4}$ | 2.57 | 0.10 | 0 | Comp. Ex. |

As is apparent from the results of Table 2 that there can be obtained advantages by the image forming method of the present invention that maximum density is high, minimum density is low and fluctuation in photographic characteristics (minimum density) due to continuous processing is scarcely caused.

EXAMPLE 2

A paper support (both sides thereof being laminated with polyethylene) was coated with the following solutions to prepare a multi-layer color photographic paper having the following structure. Coating solutions were prepared by the following manner.

Preparation of Coating Solution for First Layer 19.1 g of yellow coupler (Ex Y), 4.4 g of dye image stabilizer (Cpd-1) and 0.7 g of dye image stabilizer (Cpd-7) were dissolved in 27.2 ml of ethyl acetate and 8.2 g of solvent (Solv-3). The resulting solution was emulsified and dispersed in a 10 wt% aqueous gelatin solution containing 8 ml of 10 wt% sodium dodecylbenzenesulfonate. Separately, $2.0\times10^{-4}$ mol (per mol of silver) of each of the following blue-sensitive sensitizing dyes was added to a silver chlorobromide emulsion (cube, grain size: 0.88 μm, a coefficient of variation in grain size: 0.08, 0.2 mol % of silver bromide being localized on the surface of grain) and the mixture was subjected to sulfur sensitization. The resulting emulsion and the above emulsified dispersion were mixed and dissolved to prepare a coating solution for the first layer.

Coating solutions for the second layer to the seventh layer were prepared in the same way as in the preparation of the coating solution for the first layer. There was used sodium salt of 1-oxy-3,5-dichloro-S-triazine as the hardening agent for gelatin in each layer.

The following spectral sensitizing dyes were used for the following layers.

Blue-sensitive emulsion layer

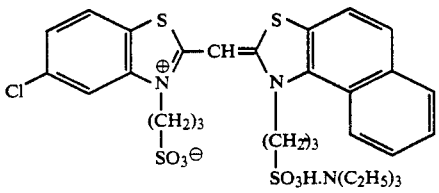

and

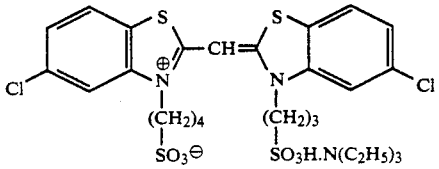

($2.0 \times 1.0^{-4}$ mol per mol of silver halide) of each of the above two dyes).

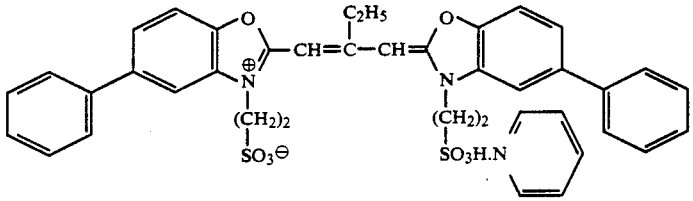

($4.0 \times 10^{-4}$ mol per mol of silver halide)

and

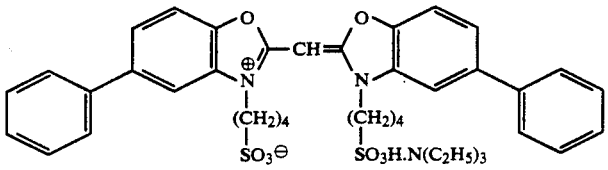

($7.0 \times 10^{-5}$ mol per mol of silver halide)

Red-sensitive emulsion

S-22
($0.9 \times 10^{-4}$ mol per mol of silver halide)

$2.6 \times 10^{-3}$ mol of the following compound per mol of silver halide was added to the red-sensitive emulsion layer.

-continued

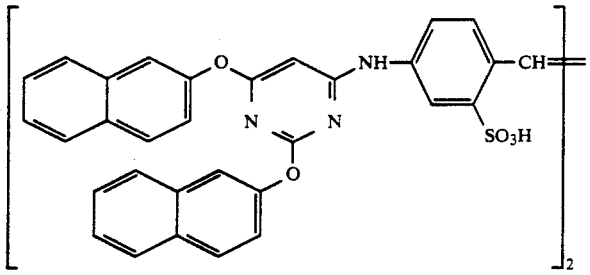

$8.5\times10^{-5}$ mol, $7.7\times10^{-4}$ mol and $2.5\times10^{-4}$ mol of 1-(5-methylureidophenyl)-5-mercapto-tetrazole per mol of silver halide were added to the blue-sensitive emulsion layer, green-sensitive emulsion layer and red-sensitive emulsion layer, respectively.

The following dyes were added to the emulsion layers to prevent irradiation.

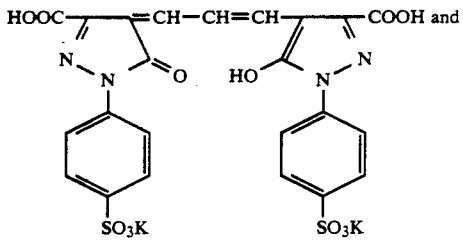

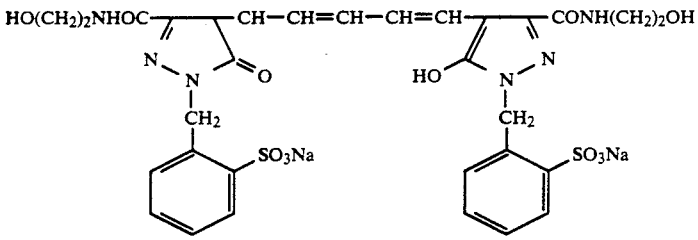

Layer Structure

Each layer had the following composition. Numerals represent coating weight (g/m²). The amounts of the silver halide emulsions are represented by coating weight in terms of silver.

Support

Polyethylene-laminated paper ((The polyethylene on the side of the first layer contained a white pigment ($TiO_2$) and a bluish dye (ultramarine)).

| | Coating weight |
|---|---|
| First layer (blue-sensitive layer) | |
| Silver chlorobromide emulsion | 0.30 |
| Gelatin | 1.86 |
| Yellow coupler (Ex Y) | 0.82 |
| Dye image stabilizer (Cpd-1) | 0.19 |
| Solvent (Solv-3) | 0.35 |
| Dye image stabilizer (Cpd-7) | 0.06 |
| Second layer (color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (green-sensitive layer) | |
| Silver chlorobromide emulsion (cube, a ⅓ (by Ag molar ratio) mixture of an emulsion having a mean grain size of 0.55 μm and an emulsion having a mean grain size of 0.39 μm, coefficient of variation: 0.10 and 0.08, respectively, 0.86 mol % of AgBr content being localized on the surfaces of grains) | 0.12 |
| Gelatin | 1.24 |
| Magenta coupler (Ex M) | 0.27 |
| Dye image stabilizer (Cpd-3) | 0.15 |
| Dye image stabilizer (Cpd-8) | 0.02 |
| Dye image stabilizer (Cpd-9) | 0.03 |
| Solvent (Solv-2) | 0.54 |

-continued

| | |
|---|---|
| Fourth layer (ultraviolet light absorbing layer) | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer (red-sensitive layer) | |
| Silver chlorobromide emulsion (cube, a ¼ (by Ag molar ratio) mixture of an emulsion having a mean grain size of 0.58 μm and an emulsion having a mean grain size of 0.45 μm, coefficient of variation: 0.09 and 0.11, respectively, 0.6 mol % of AgBr content being localized on the surfaces of grains) | 0.23 |
| Gelatin | 1.34 |
| Cyan coupler (Ex C) | 0.32 |
| Dye image stabilizer (Cpd-6) | 0.17 |
| Dye image stabilizer (Cpd-10) | 0.04 |
| Dye image stabilizer (Cpd-7) | 0.40 |
| Solvent (Solv-6) | 0.15 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acrylic-modified copolymer of polyvinyl alcohol (degree of modification: 17%) | 0.17 |
| Liquid paraffin | 0.03 |

(Ex Y) Yellow Coupler

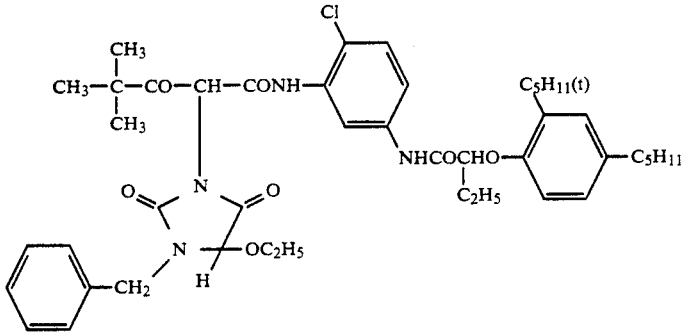

(ExM) Magenta Coupler

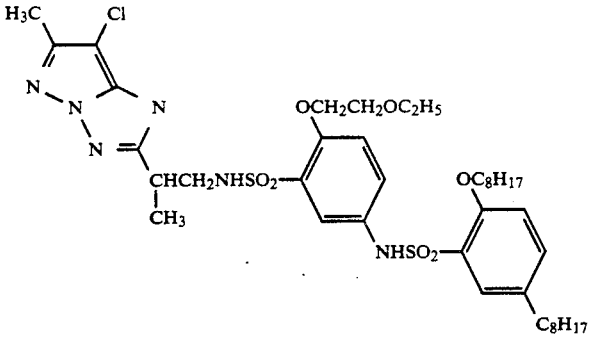

(ExC) Cyan Coupler

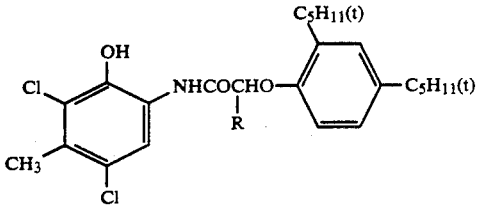

R = $C_2H_5$, R = $C_4H_9$

-continued
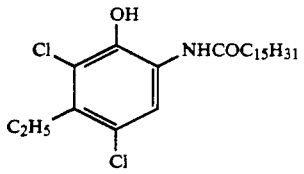
2/4/4 mixture (by weight)
(Cpd-1) Dye image stabilizer
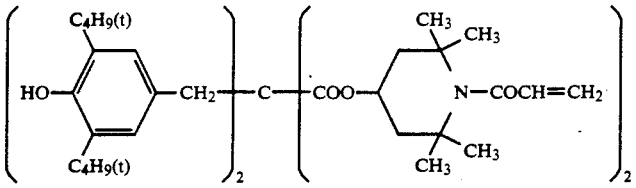
(Cpd-3) Dye image stabilizer
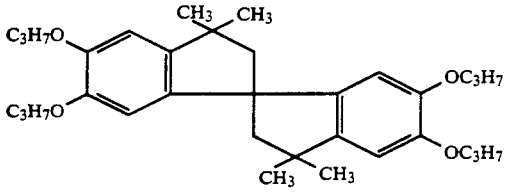
(Cpd-5) Color mixing inhibitor
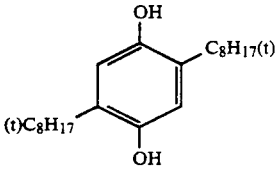
(Cpd-6) Dye image stabilizer
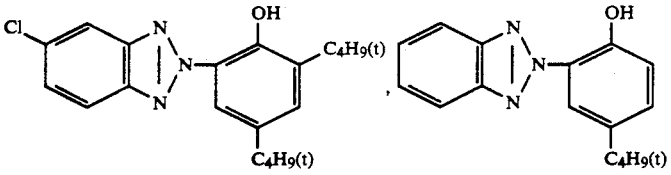
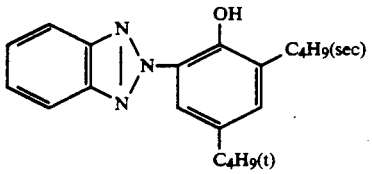
2/4/4 mixture (by weight)
(Cpd-7) Dye image stabilizer
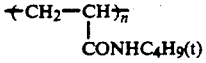
Average molecular weight: 60,000
(Cpd-8) Dye image stabilizer)

-continued
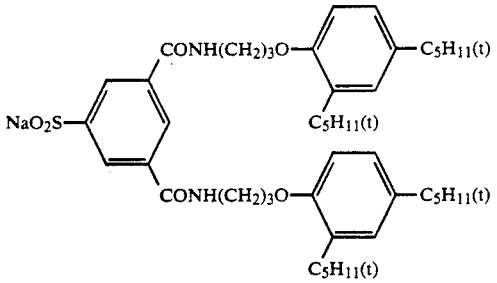
(Cpd-9) Dye image stabilizer
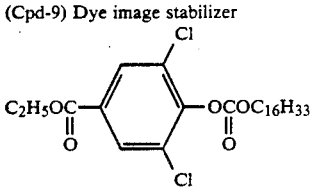
(Cpd-10) Dye image stabilizer
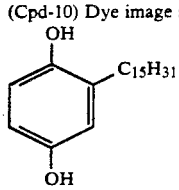
(UV-1) Ultraviolet light absorber
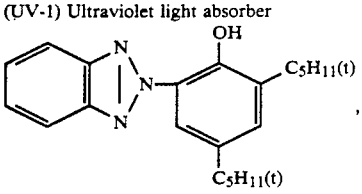
,
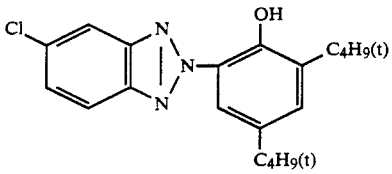
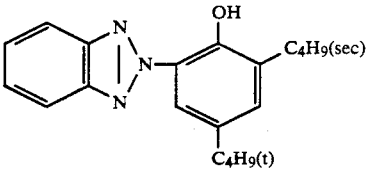
4/2/4 mixture (by weight)
(Solv-1) Solvent
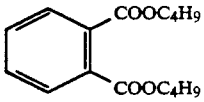
(Solv-2) Solvent
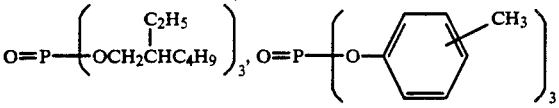
2/1 mixture (by volume)
(Solv-3) Solvent
$O{=}P{+}O{-}C_9H_{19}(iso))_3$
(Solv-4) Solvent
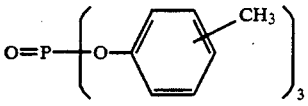

-continued (Solv-5) Solvent $COOC_8H_{17}$
|
$(CH_2)_8$
|
$COOC_8H_{17}$ (Solv-6) Solvent

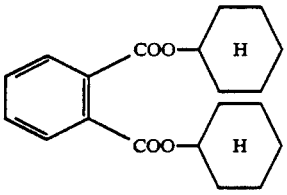

In this way, Sample H was prepared. The procedure for preparing Sample H was repeated, except that the sensitizing dye of the red-sensitive emulsion layer was replaced by Sen-1 to prepare Sample (I).

In the same way as in Example 1, Samples H and I were imagewise exposed and subjected to a running test in the following processing stages by using a paper processing machine till the color developing solution in an amount of twice as much as the tank solution (i.e., the tank capacity) was replenished.

| Processing stage | Temperature | Time | Replenishment rate* | Tank Capacity |
|---|---|---|---|---|
| Color development | 38° C. | 45 sec | 100 ml | 4 l |
| Bleaching-fixing | 30~36° C. | 45 sec | 61 ml | 4 l |
| Rinse ① | 30~37° C. | 30 sec | — | 2 l |
| Rinse ② | 30~37° C. | 30 sec | — | 2 l |
| Rinse ③ | 30~37° C. | 30 sec | 364 ml | 2 l |
| Drying | 70~80° C. | 60 sec | | |

*Replenishment rate per $m^2$ of photographic material (Three tank countercurrent system of rinse ③ → ① was used. The rinse solution from ① was sent to the bleach-fixing stage at a rate of 122 ml per $m^2$ of photographic material)

Each processing solution had the following composition.

| Color developing solution | |
|---|---|
| (Tank solution) | |
| Water | 800 ml |
| Ethylenediamine-N,N,N'-N'-tetramethylenephosphonic acid | 3.0 g |
| Triethanolamine | 8.0 g |
| Sodium chloride | see, Table 3 |
| Potassium bromide | see, Table 3 |
| Potassium carbonate | 25 g |
| N-Ethyl-N-(β-methanesulfonamido-ethyl)-3-methyl-4-aminoaniline sulfate | 5.0 g |
| Organic preservative (II-19) | 0.03 mol |
| Fluorescent brightener (WHITEX-4, manufactured by Sumitomo Chemical Co., Ltd.) | 1.0 g |
| Water to make | 1,000 ml |
| pH (25° C.) | 10.05 |
| (Replenisher) | |

-continued

| | |
|---|---|
| Ethylenediamine-N,N,N'-N'-tetramethylenephosphonic acid | 3 g/l |
| Triethanolamine | 12 g/5 l |
| Sodium chloride | see, Table 3 |
| Potassium bromide | see, Table 3 |
| Potassium carbonate | 26 g/l |
| N-Ethyl-N-(β-methanesulfonamido-ethyl)-3-methyl-4-aminoaniline sulfate | 9 g/l |
| Organic preservative (II-19) | 7 g/l |
| Fluorescent brightener (WHITEX-4, manufactured by Sumitomo Chemical Co., Ltd.) | 2.5 g/l |
| Water to make | 1,000 ml |
| pH (25° C.) (adjusted by KOH or $H_2SO_4$) | 10.55 |

| Bleach-fixing solution | |
|---|---|
| (Tank Solution) | |
| Water | 400 ml |
| Ammonium thiosulfate (70 wt %) | 100 ml |
| Sodium sulfite | 38 g |
| Ethylenediaminetetraacetic acid | 55 g |
| Iron (III) ammonium Disodium ethylenediaminetetraacetate | 5 g |
| Glacial acetic acid | 9 g |
| Water to make | 1,000 ml |
| pH (25° C.) | 5.40 |

Replenishers

Solution which was concentrated to 2.5 times of the tank solution.

Rinsing Solution (Tank Solution and Replenisher Being the Same)

Ion-exchanged water (the concentration of calcium and magnesium each was 3 ppm or lower).

Running test was carried out while correcting evaporation and concentration by adding distilled water in an amount corresponding to the evaporated amount to the color developing solution, the bleach-fixing solution and the rinsing solution.

Maximum density Dmax of cyan at the time of initiating the running test and an increase ΔDmin in minimum density of cyan till the end of the running test were measured. The results are shown in Table 3.

TABLE 3

| | | Chlorine ion concn. in developing solution (mol/l) | | Bromine ion conc. in developing solution (mol/l) | | | | | |
|---|---|---|---|---|---|---|---|---|---|
| Experiment | Sample | Tank solution | Replenisher | Tank solution | Replenisher | Dmax | Dmin | Δ Dmin | Remarks |
| 12 | H | $4.3 \times 10^{-2}$ | 0 | $1.2 \times 10^{-4}$ | 0 | 2.92 | 0.11 | 0 | Invention |
| 13 | I | $4.3 \times 10^{-2}$ | 0 | $1.2 \times 10^{-4}$ | 0 | 2.90 | 0.11 | 0.05 | Comp. Ex. |

TABLE 3-continued

| Experiment | Sample | Chlorine ion concn. in developing solution (mol/l) Tank solution | Chlorine ion concn. in developing solution (mol/l) Replenisher | Bromine ion conc. in developing solution (mol/l) Tank solution | Bromine ion conc. in developing solution (mol/l) Replenisher | Dmax | Dmin | Δ Dmin | Remarks |
|---|---|---|---|---|---|---|---|---|---|
| 14 | H | $7 \times 10^{-2}$ | $2.7 \times 10^{-2}$ | $2.5 \times 10^{-4}$ | $1.3 \times 10^{-4}$ | 2.90 | 0.10 | 0 | Invention |
| 15 | H | $1.4 \times 10^{-2}$ | 0 | $2 \times 10^{-5}$ | 0 | 2.90 | 0.12 | 0.04 | Comp. Ex. |
| 16 | H | $6 \times 10^{-2}$ | 0 | 0 | 0 | 2.94 | 0.10 | 0.04 | Comp. Ex. |

As is apparent from the results of Table 3 that the effect obtained by the image forming method of the present invention is remarkable even with the multi-coated samples of Example 2.

According to the present invention, there can be provided an image forming method which gives high maximum density and low minimum density and scarcely causes fluctuation in photographic characteristics due to continuous processing.

While the present invention has been described in detail and with reference to specific embodiments thereof, it is apparent to one skilled in the art that various changes and modifications can be made therein without departing from the spirit, and the scope of the present invention.

What is claimed is:

1. A method for forming an image, which comprises processing an imagewise exposed silver halide color photographic material with a color developing solution containing at least one aromatic primary amine color developing agent, comprising: processing an imagewise exposed silver halide color photographic material having at least one layer containing a compound represented by formula (S-I) and a silver halide emulsion comprising at least 80 mol% of silver chloride with a color developing solution containing chlorine ion in an amount of $3.5\times10^{-2}$ to $1.5\times10^{-1}$ mol/l and bromine ion in an amount of $5\times10^{-5}$ to $5\times10^{-4}$ mol/l:

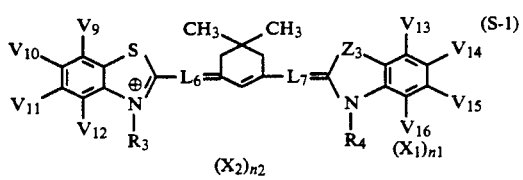

(S-I)

wherein $Z_3$ represents an oxygen atom or sulfur atom; $L_6$ and $L_7$ each represents a methine group; $R_3$ and $R_4$ may be the same or different groups and each represents an alkyl group; $R_3$ and $L_6$ or $R_4$ and $L_7$ may be combined together to form a five-membered or six-membered carbon ring; $V_9$, $V_{10}$, $V_{11}$, $V_{12}$, $V_{13}$, $V_{14}$, $V_{15}$ and $V_{16}$ each represents a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group or an aryl group, provided that among $V_9$ to $V_{16}$, two groups attached to adjacent carbon atoms cannot be combined together to form a condensed ring, and in the case where each Hammett's $\sigma_p$ value is referred to as $\sigma_{pi}$(i=9−16) and $Y=\sigma_{p9}+\sigma_{p10}+\sigma_{p11}+\sigma_{p12}+\sigma_{p13}+\sigma_{p14}+\sigma_{p15}+\sigma_{p16}$, when $Z_3$ is an oxygen atom, $Y\leqq-0.08$ and when $Z_3$ is a sulfur atom, $Y\leqq-0.15$, and $(X_2)_{n2}$ represents a counter ion (electric charge-balancing counter ion), and $n_2$ is a value required for the neutralization of 0 or more electric charges.

2. The method as claimed in claim 1, wherein said color developing solution contains chlorine ion in an amount of $4\times10^{-2}$ to $1\times10^{-1}$ mol/l.

3. The method as claimed in claim 1, wherein when $Z_3$ is an oxygen atom, $-0.90\leqq Y\leqq-0.17$; and when $Z_3$ is a sulfur atom, $-1.05\leqq Y\leqq-0.34$.

4. The method as claimed in claim 1, wherein said color developing solution contains at least one organic preservative selected from hydroxylamine derivatives and hydrazine derivatives in an amount of 0.005 to 0.5 mol/l.

5. The method as claimed in claim 1, wherein said silver halide color photographic material has a total coating weight of silver of not more than 0.75 g/m$^2$.

6. The method as claimed in claim 1, wherein said $Y\leqq-0.15$ when $Z_3$ is an oxygen atom, and said $Y\leqq-0.30$ when $Z_3$ is a sulfur atom.

7. The method as claimed in claim 1, wherein said silver halide emulsion comprises at least 95 mol% of silver chloride.

* * * * *